US008037652B2

(12) United States Patent
Marshall et al.

(10) Patent No.: US 8,037,652 B2
(45) Date of Patent: Oct. 18, 2011

(54) INSULATED CONCRETE FORM

(75) Inventors: Dale Marshall, Calgary (CA); Tony Yeung, Calgary (CA); Carlo Galasso, Calgary (CA)

(73) Assignee: Encon Environmental Construction Solutions Inc., Calgary (CA)

( * ) Notice: Subject to any disclaimer, the term of this patent is extended or adjusted under 35 U.S.C. 154(b) by 910 days.

(21) Appl. No.: 11/762,967

(22) Filed: Jun. 14, 2007

(65) Prior Publication Data

US 2007/0294970 A1 Dec. 27, 2007

Related U.S. Application Data

(60) Provisional application No. 60/813,356, filed on Jun. 14, 2006.

(51) Int. Cl.
*E04B 2/00* (2006.01)

(52) U.S. Cl. ..... 52/309.11; 52/309.12; 52/426; 52/427; 52/562; 52/564

(58) Field of Classification Search ..... 52/309.11, 52/309.12, 424, 425, 426, 427, 428, 442, 52/562, 564, 565

See application file for complete search history.

(56) References Cited

U.S. PATENT DOCUMENTS

| | | | | |
|---|---|---|---|---|
| 4,222,501 | A | | 9/1980 | Hammett et al. |
| 4,706,429 | A | | 11/1987 | Young |
| 4,884,382 | A | * | 12/1989 | Horobin ..... 52/426 |
| 4,889,310 | A | * | 12/1989 | Boeshart ..... 249/41 |
| 4,894,969 | A | * | 1/1990 | Horobin ..... 52/309.12 |
| 5,390,459 | A | | 2/1995 | Mensen |
| 5,428,933 | A | * | 7/1995 | Philippe ..... 52/592.1 |
| 5,459,971 | A | | 10/1995 | Sparkman |

(Continued)

FOREIGN PATENT DOCUMENTS

| | | |
|---|---|---|
| CA | 2 315 638 | 7/1999 |
| CA | 2 402 580 | 6/2005 |

OTHER PUBLICATIONS

Nudura Integrated Building Technology; Product Catalog and Technical Bulletins, May 2006.

(Continued)

*Primary Examiner* — Brian Glessner
*Assistant Examiner* — James Buckle, Jr.
(74) *Attorney, Agent, or Firm* — Notaro, Michalos & Zaccaria P.C.

(57) ABSTRACT

There is described an apparatus for a concrete form for an insulated wall. The apparatus comprises first and second wall panels arranged in opposed spaced apart parallel relationship, each panel having an inner surface, an outer surface, an upper edge surface, a lower edge surface and end surfaces. A plurality of retainers are secured within each of said first and second panels at spaced apart intervals, each retainer including a connecting portion extending outwardly from the inner surface of each panel, and an anchoring portion. The anchoring portion includes a framework disposed within the panels, an upper connector extending upwardly from each panel's upper edge surface and a lower connector extending downwardly from each panel's lower edge surface. The upper and lower connectors are adapted to respectively engage the upper and lower connectors of the next vertically adjacent panel to securely attach the panels together. A plurality of cross webs extends between the first and second panels to tie them together, the cross webs being adapted for respective connection to the connecting portions of opposed retainers in the first and second panels.

53 Claims, 25 Drawing Sheets

U.S. PATENT DOCUMENTS

| | | | | |
|---|---|---|---|---|
| 5,553,432 | A * | 9/1996 | Levin | 52/309.12 |
| 5,625,989 | A | 5/1997 | Brubaker et al. | |
| 5,657,600 | A * | 8/1997 | Mensen | 52/426 |
| 5,657,660 | A | 8/1997 | Tingwall | |
| 5,701,170 | A | 12/1997 | Powers et al. | |
| 5,704,180 | A * | 1/1998 | Boeck | 52/426 |
| 5,709,060 | A * | 1/1998 | Vaughan et al. | 52/426 |
| 5,735,093 | A * | 4/1998 | Grutsch | 52/309.11 |
| 5,809,727 | A | 9/1998 | Mensen | |
| 5,896,714 | A | 4/1999 | Cymbala et al. | |
| 6,170,220 | B1 | 1/2001 | Moore, Jr. | |
| 6,230,462 | B1 * | 5/2001 | Beliveau | 52/426 |
| 6,240,692 | B1 * | 6/2001 | Yost et al. | 52/426 |
| 6,314,694 | B1 * | 11/2001 | Cooper et al. | 52/309.12 |
| 6,314,697 | B1 * | 11/2001 | Moore, Jr. | 52/426 |
| 6,318,040 | B1 * | 11/2001 | Moore, Jr. | 52/426 |
| 6,336,301 | B1 * | 1/2002 | Moore, Jr. | 52/426 |
| 6,363,683 | B1 | 4/2002 | Moore, Jr. | |
| 6,401,419 | B1 * | 6/2002 | Beliveau | 52/592.6 |
| 6,438,918 | B2 * | 8/2002 | Moore et al. | 52/426 |
| 6,481,178 | B2 * | 11/2002 | Moore, Jr. | 52/741.13 |
| 6,526,713 | B2 * | 3/2003 | Moore, Jr. | 52/309.11 |
| 6,536,172 | B1 * | 3/2003 | Amend | 52/426 |
| 6,609,340 | B2 * | 8/2003 | Moore et al. | 52/309.11 |
| 6,792,729 | B2 * | 9/2004 | Beliveau | 52/426 |
| 6,820,384 | B1 * | 11/2004 | Pfeiffer | 52/426 |
| 6,915,613 | B2 * | 7/2005 | Wostal et al. | 52/426 |
| 7,032,357 | B2 * | 4/2006 | Cooper et al. | 52/426 |
| 7,082,731 | B2 | 8/2006 | Patz et al. | |
| 7,082,732 | B2 * | 8/2006 | Titishov | 52/426 |
| 7,284,351 | B2 * | 10/2007 | Cooper et al. | 52/424 |
| 2001/0027630 | A1 * | 10/2001 | Moore et al. | 52/741.13 |
| 2001/0027631 | A1 * | 10/2001 | Moore et al. | 52/741.13 |
| 2002/0026760 | A1 * | 3/2002 | Moore, Jr. | 52/309.11 |
| 2002/0026761 | A1 * | 3/2002 | Moore, Jr. | 52/309.11 |
| 2002/0116889 | A1 * | 8/2002 | Moore, Jr. | 52/426 |
| 2002/0124508 | A1 * | 9/2002 | Dunn et al. | 52/426 |
| 2003/0005659 | A1 * | 1/2003 | Moore, Jr. | 52/473 |
| 2003/0029106 | A1 * | 2/2003 | Cooper et al. | 52/309.11 |
| 2004/0040240 | A1 * | 3/2004 | Patz et al. | 52/309.11 |
| 2004/0045238 | A1 * | 3/2004 | Dunn et al. | 52/309.11 |
| 2004/0103609 | A1 * | 6/2004 | Wostal et al. | 52/426 |
| 2004/0159061 | A1 * | 8/2004 | Schmidt | 52/415 |
| 2005/0028466 | A1 * | 2/2005 | Titishov | 52/474 |
| 2005/0108963 | A1 * | 5/2005 | Wostal et al. | 52/426 |
| 2005/0223669 | A1 * | 10/2005 | Cymbala et al. | 52/426 |
| 2006/0117690 | A1 * | 6/2006 | Garrett | 52/309.11 |

OTHER PUBLICATIONS

Nudura General Specs, 2004.
Plasti-Fab Advantage ICF Sysrtem, 2004.
Plasti-Fab Advantage ICF System Insulating Concrete Forming System, 2004.
Reward Wall Systems Products Specification, 2007.
Plasti-Fab Technical Manual, Oct. 2, 2003.
Plasti-Fab Appendix 1—Structural Detail Drawings, Oct. 2, 2003.
Arxx 2.1 Design Procedures, undated.
Arxx 2.2 Laying Out Walls, undated.
Arxx Design Guide 1.1, undated.
Formtech Insulated Concrete Forms, Building with the Best, undated.
BB BuildBlock, undated.
Nudura Floor Technology—Technical Bulletin, undated.
Arxx 3.1 The CAD Library, undated.

* cited by examiner

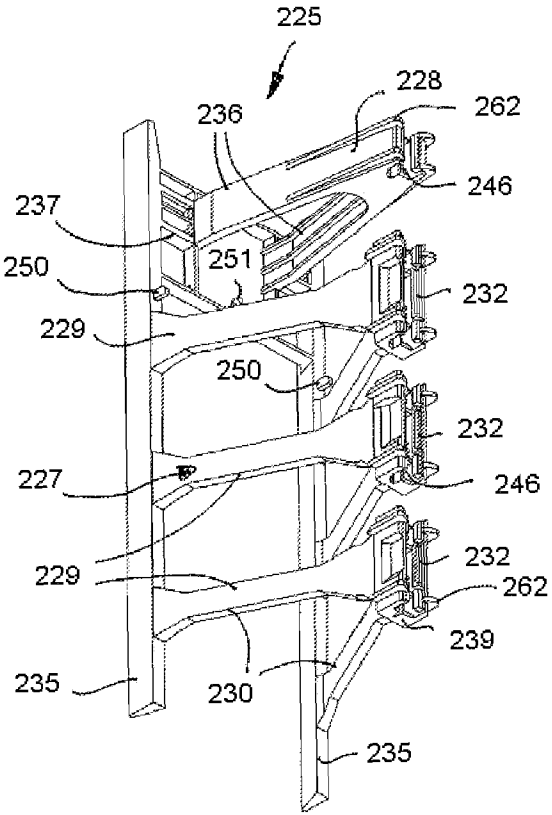
FIG. 27
FIG. 26
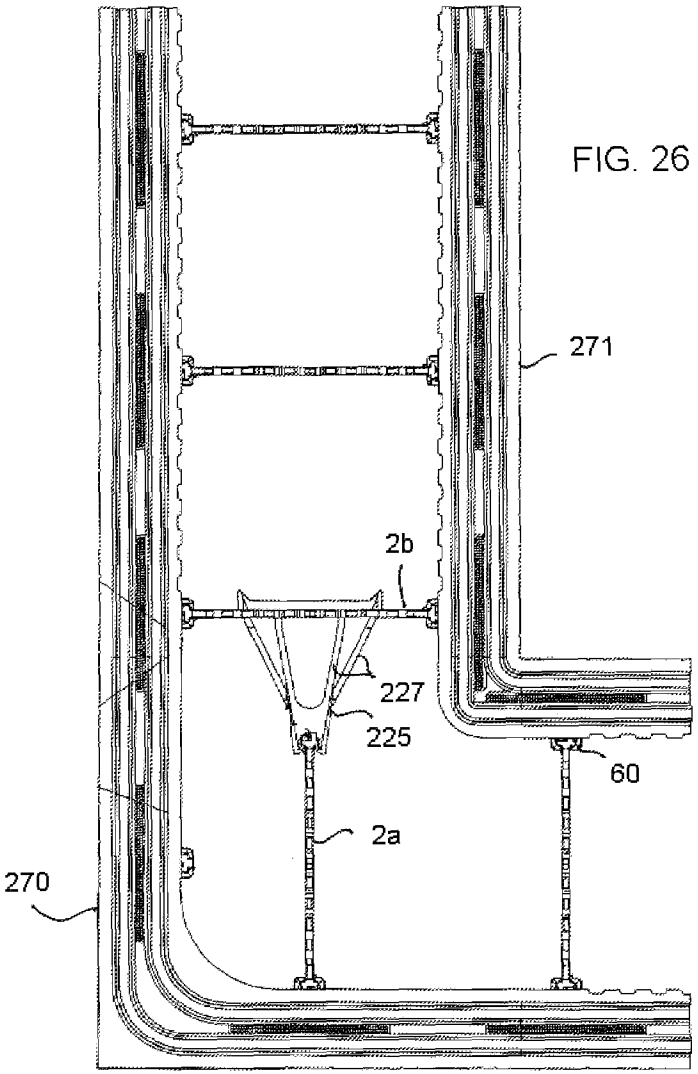

INSULATED CONCRETE FORM

This application claims priority under 35 U.S.C §1199e0 to U.S. Provisional Application Ser. No. 60/813,356, entitled "INSULATED CONCRETE FORM", filed on Jun. 14, 2006.

FIELD OF THE INVENTION

The present invention relates to a wall forming structure and to particularly to an insulated concrete form (ICF) system and apparatus.

BACKGROUND TO THE INVENTION

Traditionally, concrete walls have been poured between braced wooden forms. Once the forms are removed, the walls are separately insulated either by means of insulation batts placed between wooden studs or using panels of foam insulation, typically expanded polystyrene (EPS) panels adhered to the walls in ways known in the art. Finishing surfaces are then attached either to the wooden studs or to the EPS panels. Either method when used in combination with traditional wooden forms is time consuming which increases labour costs.

In response, the industry has developed insulated concrete forms which themselves are the forms used for concrete walls (usually foundation walls) that remain in place after the concrete has cured. The ICFs provide both thermal and acoustical insulation, as well as a system for the connection of interior and exterior wall finishes and treatments, such as wall board, panelling, stucco and the many other treatments known and used in the construction industry.

Current ICFs are still developmental and there remains numerous problems to resolve. These include providing strong and rigid connections between upper and lower blocks that make up the ICFs, the minimization of lateral movement between horizontally adjacent blocks, sufficient flexibility in the placement of vertically adjacent blocks, economical manufacturing and field assembly, cornering solutions and many other aspects that will be addressed in greater detail below.

SUMMARY OF THE INVENTION

The insulated concrete form of the present invention is intended to obviate and mitigate from the numerous disadvantages of prior art insulated concrete forms.

The ICF that will be described below provides for, amongst other things, enhanced strength and rigidity in the retainer members embedded within the foam panels, cross webs that link opposing retainers that are hingedly connected to retainers for compact storage and shipment, and the provision of novel upper and lower connectors that allow strong rigid connections between vertically adjacent panels that resists both horizontal and vertical separation of the panels due to the pressure of the concrete pour and yet provide almost infinite adjustability in the precise positioning of the panels relative to one another and manufacturing efficiencies.

According to the present invention then, there is provided apparatus for a concrete form for an insulated wall, comprising first and second wall panels arranged in opposed spaced apart parallel relationship, each panel having an inner surface, an outer surface, an upper edge surface, a lower edge surface and end surfaces; a plurality of retainer means secured within each of said first and second panels at spaced apart intervals, each retainer means including a connecting portion extending outwardly from said inner surface of each of said panels, and an anchoring portion including a framework disposed within said panels; an upper connector extending upwardly from each panel's upper edge surface; and a lower connector extending downwardly from each panel's lower edge surface, said upper and lower connectors being adapted to respectively engage selected ones of the upper and lower connectors of the next vertically adjacent panel to securely attach said panels together; and a plurality of cross webs extending between said first and second panels to tie them together, said cross webs being adapted for respective connection to the connecting portion of opposed retainer means in said first and second panels.

According to another aspect of the present invention, there is also provided a retainer for an insulating panel forming part of an insulated concrete form, said retainer comprising a connecting portion for connection to a cross web used to connect opposing ones of said panels together; and an anchoring portion including a framework to be disposed within the insulating panel; an upper connector extending upwardly from said framework; and a lower connector extending downwardly from said framework, said upper and lower connectors being adapted to respectively engage the upper and lower connectors of vertically adjacent retainers, whereby the panels can be stackably connected together.

According to yet another aspect of the present invention, there is also provided a cross web for connecting together opposed insulating panels of an insulated concrete form, the cross web comprising a pair of parallel, spaced apart side rails, each of said rails having an upper and lower end; a plurality of cross members extending orthogonally between the side rails at spaced apart intervals; wherein each of said side rails includes an elongated generally planar spine having a front surface, a rear surface and right and left side end surfaces; said rear surface having thereon longitudinally extending flange means extending orthogonally outwardly therefrom.

According to yet another aspect of the present invention, there is also provided apparatus to form a corner in an insulated concrete form, comprising a first outside corner wall panel and a second inside corner wall panel, said first and second panels arranged in opposed spaced apart relationship to define said corner between them, each panel having an inner surface, an outer surface, an upper edge surface, a lower edge surface and end surfaces; a plurality of retainer means secured within each of said first and second panels at spaced apart intervals, each retainer means including a connecting portion extending outwardly from said inner surface of each of said panels; a plurality of cross webs extending between said first and second panels to tie them together, said cross webs being adapted for respective connection to the connecting portion of opposed retainer means in said first and second panels; and a cross web connector for connecting together two orthogonally disposed cross webs at said corner.

According to yet another aspect of the present invention, there is also provided apparatus to form a T-shaped intersection in an insulated concrete form, comprising a first inside corner wall panel, a second opposite inside corner wall panel and a third straight wall panel, said first, second and third panel being arranged to define a T-intersection between them, each of said panels having an inner surface, an outer surface, an upper edge surface, a lower edge surface and end surfaces; a plurality of retainer means secured within each of said first, second and third panels at spaced apart intervals, each retainer means including a connecting portion extending outwardly from said inner surface of each of said panels; a plurality of cross webs extending between said first, second and third panels to tie them together, said cross webs being adapted for respective connection to the connecting portion of opposed retainer means in said first and second panels; and a cross web connector for connecting together two orthogonally disposed cross webs at said T-intersection.

According to yet another aspect of the present invention, there is also provided a corner anchor for use in the corner of an insulated concrete form, the form including first and second corner wall panels arranged in opposed spaced apart relationship to define a corner between them and retainer means inside the panels on opposite sides of the corner, said corner anchor comprising a pair of orthogonally extending wall surfaces, each wall surface having an inner end and an outer end, the inner ends being connected together to form an outside corner; and connecting means associated with the outer ends of said wall surfaces to engage cooperating means in the retainers on the opposite sides of the corner, wherein said corner anchor connects said retainer means together to reinforce the corner defined by said first and second panels.

According to yet another aspect of the present invention, there is also provided connectors for connecting vertically stackable insulating panels of an insulated concrete form, comprising one or more upper connectors extending upwardly from an upper surface of said panels; one or more lower connectors extending downwardly from a lower surface of said panels; wherein one of said upper and lower connectors is a male configured component and the other of said upper and lower connectors is a female configured receptor for receiving said male configured component thereinto for a separation restraining connection therebetween, said male configured component comprising a plurality of teeth extending along the length thereof and said female configured receptor being cooperatively formed to engage some or all of said teeth to prevent lateral movement of said connectors relative to one another.

BRIEF DESCRIPTION OF THE DRAWINGS

Preferred embodiments of the present invention will now be described in greater detail and will be better understood when read in conjunction with the following drawings in which:

FIG. 26 is a plan view of the corner block of FIG. 25;

FIG. 27 is a bottom perspective view of a T-web connector used in forming a corner;

DETAILED DESCRIPTION

Figure 1:
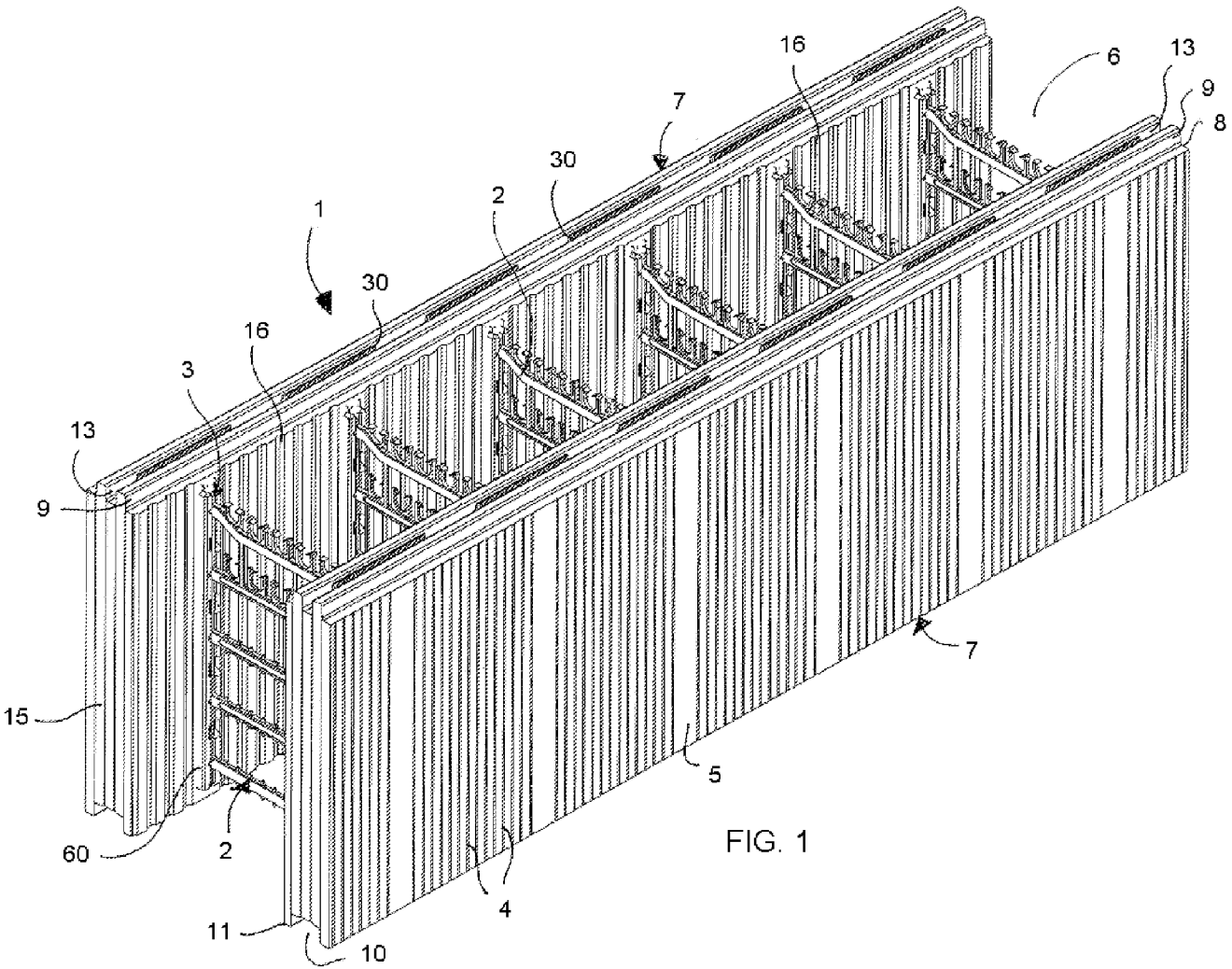
FIG. 1 is a perspective view of a single straight block which is the basic unit of the present insulated concrete form.

Referring initially to FIG. 1, there is shown a single discrete straight ICF block 1 which is the basic building unit of the present ICF system. These blocks will typically be 48 inches in length and 16 inches high although these dimensions can be varied up or down depending on job requirements. These blocks are placed end to end for the length of the wall and are stacked vertically, typically in a brick or staggered pattern, for the wall's height. The width of the block will vary with the width of the concrete wall being formed, which typically will vary from 4 inches to 10 inches of concrete in thickness. Each block consists of opposed spaced apart panels 7 of a moldable insulating material in the nature of a plastic foam such as expanded polystyrene, known as EPS, which is formed into rigid slabs that provide strength and rigidity as is known in the art. The specification of EPS is by example only, and the use of other insulating foam materials is contemplated within the scope of the present invention.

Panels 7 are spaced apart to define a cavity 6 between them, the width of which will vary depending upon the thickness of concrete required for the wall being formed. The desired spacing between the panels is maintained and the panels are connected together by means of a series of cross webs 2 that engage retainers 3 which are inserts molded into panels 7 as will be described below. The retainers are the receptors for cross webs 2 and as will also be described below, they also interconnect panels 7 both vertically and horizontally.

Panels 7 are preferably formed with a number of integral features that facilitate their use. These include vertical striations 4 on their outer surfaces, conveniently located at ½ inch intervals for use as a guide when cutting the panels to length. Also on the outer surfaces are spaced apart strips 5 that provide a visual indication of the location of fastening strips on retainers 3 that are adapting to receive screws, nails and other fasteners used to attach wall treatments for finishing or covering the panels' outer surfaces.

The upper edge 8 of each panel 7 includes continuous longitudinally extending male sealing strips 9 which are adapted to fit sealingly into a female longitudinally continuous channel 10 formed in each panel's lower edge 11. In this context, "sealingly" means that the sealing strips 9 fit closely into channel 10 to provide at least some although not necessarily perfect sealing between them. A central, continuous longitudinally extending channel 13 is formed between sealing strips 9. This channel encloses connectors 30 and 40 which are respectively located at the upper and lower ends of retainers 3 when blocks 1 are vertically assembled together. The connectors are used to interconnect blocks 1 top to bottom and to prevent horizontally adjacent blocks from moving laterally relative to one another. The connectors will be described in greater detail below.

Channel 13 is preferably continuous to facilitate the removal of any debris, snow or ice that might settle into it and that would otherwise prevent vertically adjacent blocks from interlocking with each other.

Each panel 7 also includes vertical mating strips 15 for end to end alignment and connection of blocks 1. The strips can be adhesive in nature for secure moisture resistant bonding.

The inner facing surface of panel 7 includes spaced apart vertical striations 16 which provide pathways for draining moisture that seeps from the curing concrete or any other moisture that might penetrate into the walls at a subsequent time.

Reference will now be made to FIGS. 2, 3, 4 and 5 for a more detailed description of cross webs 2. The cross webs will typically be separately injection molded plastic parts so that they can be factory unitized into blocks 1 in a hinged, collapsible configuration for more efficient shipment and storage. In the alternative, the cross webs can be shipped as discrete components and assembled on site. This feature saves on shipping costs and reduces waste. The cross webs are used only in blocks within the formed structure and can be scavenged from cut blocks. The webs will be manufactured in different widths depending on the size of cavity 6 between panels 7. Widths of 4 inches, 6 inches, 8 inches and 10 inches will be typical but different widths are contemplated and it is also possible to customize their size. Although plastic is preferred, the cross webs can be made from other materials such as metal.

Figure 4:
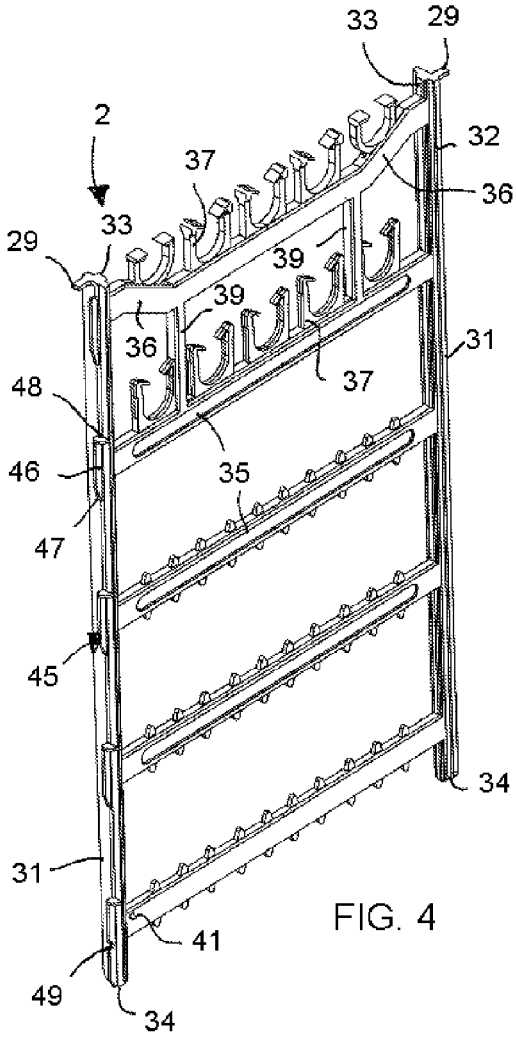
FIG. 4 is a perspective view of a cross web which is a component of the insulated concrete form.
Figure 5:
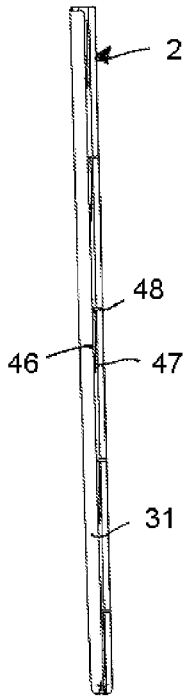
FIG. 5 is a side elevational view of the cross web of FIG. 4.

Referring now specifically to FIG. 4, each cross web, regardless of width, has the same general components. As will be seen, the cross web is a framework consisting of a pair of spaced apart, parallel vertical side rails 31 connected together by a plurality of cross members 35. The use of five cross members is felt to be optimal for a standard 16 inch high block 1, but this number can be varied as required. Each side rail is generally T-shaped when viewed in horizontal cross-section (see for example FIG. 16), consisting of a spine 32 and an inwardly extending continuous bead 33. Cross members 35 integrally connect to beads 33 and are the same width as the beads. As will be described below, side rails 31 slidably engage retainers 3 and the fact that the rails are continuous facilitates insertion and also optimally distributes the load from the poured concrete over their complete length to the retainer. The lower end 34 of each rail is rounded or chamfered to facilitate insertion into the retainer and the rails themselves can be tapered from top to bottom for ease of insertion. The upper end of each rail includes a tab 29 that prevents upside down insertion of the cross web into the retainer and provides a surface that aids insertion of the cross web into the retainer when the next row of blocks is assembled onto the wall into the retainer.

Cross members 35 extend horizontally between the side rails except for the uppermost one which is downwardly deviated at 36. Some or all of the cross members and at least the upper one or two of them, are formed with clips 37 which are sized to snap fit with reinforcing bars (not shown). The clips will be sized for the rebar being used, such as ½, ⅝ or even ¾ inch for particularly wide walls. Clips 37 allow the rebar to be laid or snapped into cavity 6 between panels 7, and with the appropriate overlap of the rebar, there is no requirement for tying the rebar as is normal practice. This saves time and money. The clips automatically space the rebar to be surrounded by the concrete and allows the rebar to be properly placed over openings for windows, doors and other openings where portions of the foam panels have to be cut away.

The downward deviation 36 of the uppermost cross web provides clearance for the rebar relative to the next upwardly adjacent block or for a sill plate anchored to the top of the uppermost of blocks 1 at the top of a wall. The lowermost cross member is located as low as possible to balance the pressure of the concrete in cavity 6 and to prevent any separation of panels 7 due to that pressure. Vertical braces 39 formed between the two uppermost cross members serve to distribute the load from the rebar and to provide some extra strength to the uppermost cross member against the force of falling concrete during the pour and the weight of the concrete afterwards. The lowermost cross member includes a small protrusion 41 which serves as a detente to control the length of the initial insertion of the cross web into the retainer during initial assembly for purposes that will be described in detail below.

Figure 6:
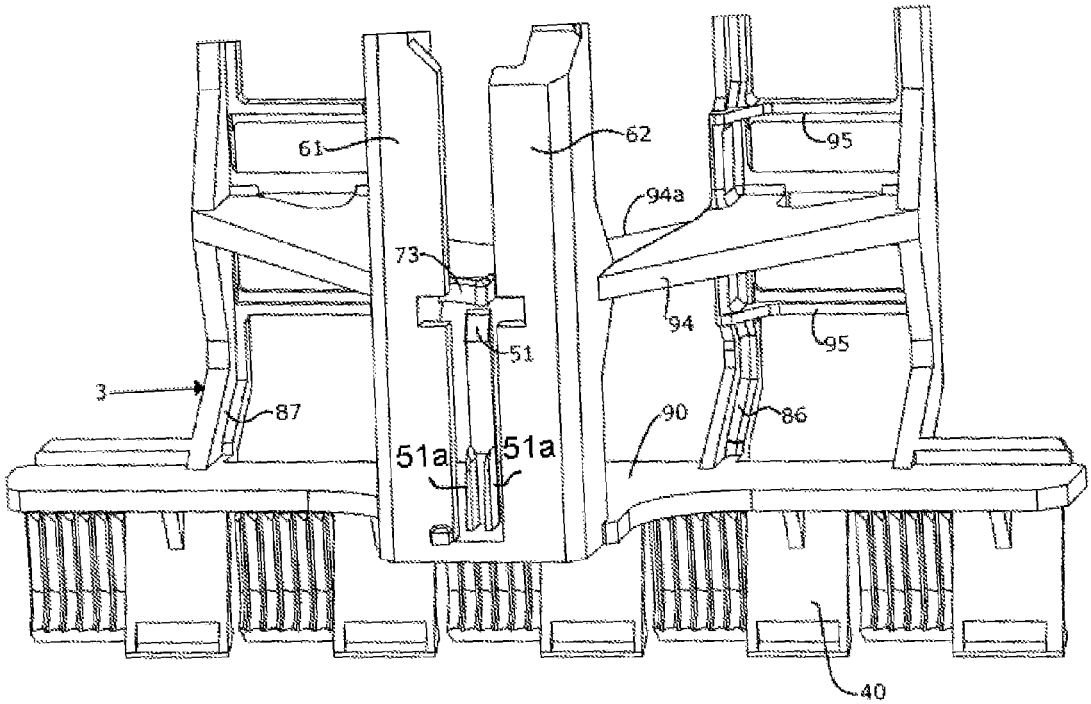
FIG. 6 is an enlarged view of the lower end of a retainer forming part of the present ICF.

Arranged on the outwardly facing surface of each side rail 31 are a plurality of vertically spaced apart small flanges 45, each flange positioned opposite the ends of horizontal cross members 35. Each flange includes a vertical leg 46 rounded or bevelled at its lower end 47 to facilitate insertion into retainer 3. All but the uppermost flange also includes a quarter circle horizontal web 48, the uppermost flange being optimally formed without one of these. The vertical leg 46 of the lowermost flange is elongated and includes a notch 49 that engages a spring tab 51 located at the lower end of retainer 3 which is most clearly visible in FIG. 6. The connection between notch 49 and spring tab 51 prevents uplift of the cross web as the concrete is poured into cavity 6. As will be appreciated, the cross webs are considerably lighter than the concrete and have a tendency to float if not restrained. The connection also prevents inadvertent removal of the cross webs during handling of the blocks. The lower end of spring tab 51 includes a pair of spaced apart guides 51*a* which define a slot between them. This slot receives a part of flange 46 below notch 49 when the cross web is fully inserted into retainer 3. This contact limits rotation of the cross web relative to the retainer and reduces "racking" of the assembled blocks. When looking at the side view of the cross web in FIG. 5, it will be seen that vertical flange legs 46 are offset slightly to the right of the vertical rail's 31 center line. The purpose for this will be described below, but briefly, these flanges move against cams in the retainer when the cross webs are pivoted from their folded position to their open position, the cams pushing against the flanges to move the cross web into its correct position relative to the retainer.

Reference will now be made to FIGS. 7, 8, 9 and 15 showing the details of retainers 3.

Retainers 3 are anchored inside panels 7 by placing the retainers at the required intervals in the mold for the panels and then injecting the plastic foam EPS into the molds to surround and encase the retainers. The retainers themselves are injection molded components using polypropylene or any other suitably strong, flexible and durable plastic material. The retainers can be made of metal but at increased cost.

Each retainer comprises three main portions.

Figure 2:
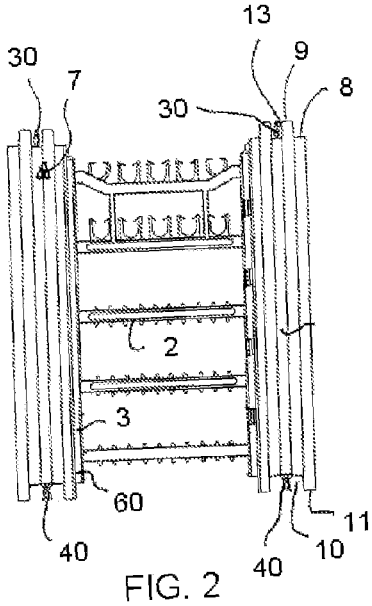
FIG. 2 is an end elevational view of the block of FIG. 1.
Figure 3:
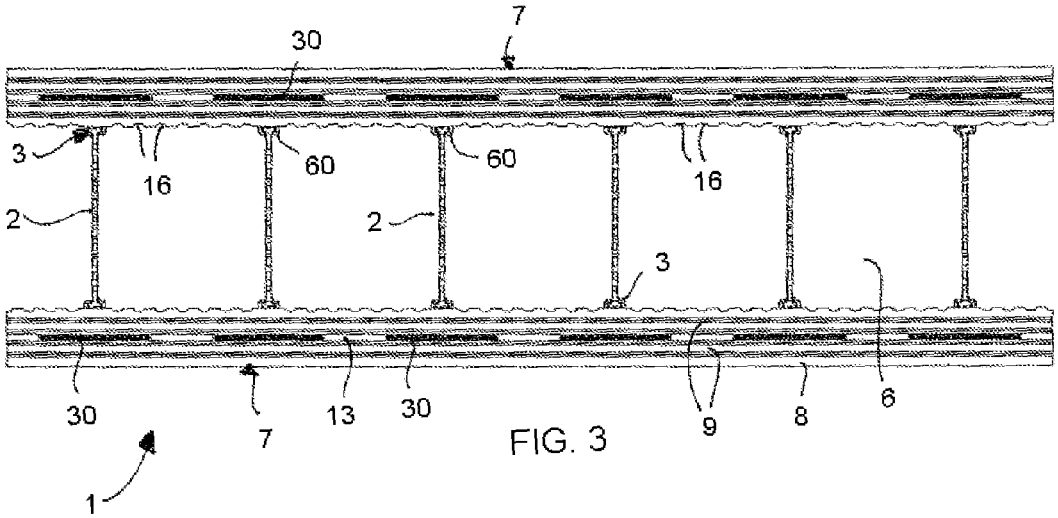
FIG. 3 is a top plan view of the block of FIG. 1.

The first is a connecting portion 60 that slidingly receives one of the side rails 31 of cross webs 2 and which therefore extends outwardly from the inner surface of panel 7 into cavity 6 as seen most clearly in FIGS. 2 and 3.

The second major portion of the retainer is an anchoring portion 80 which is fully enclosed in the foam with the exception of upper and lower connectors 30 and 40 respectively, which project outwardly from the upper and lower edges of each panel 7. Encasing the anchoring portion in the foam, and its generally triangular cross-sectional shape, ensures a strong permanent connection between the two so that they cannot separate other than by destruction of the foam. As well, the width of retainer 3, typically about 3 inches, provides greater distribution of the loads resulting from the pressure of the concrete.

Figure 9:
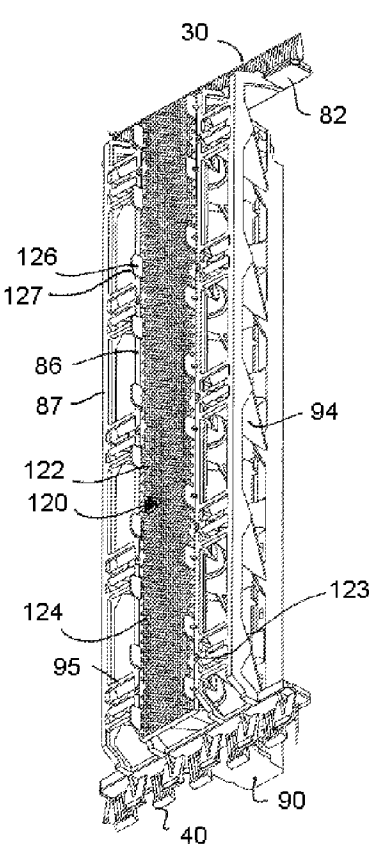
FIG. 9 is a rear perspective view of the retainer of FIG. 7 with a fastening strip attached.
Figure 8:
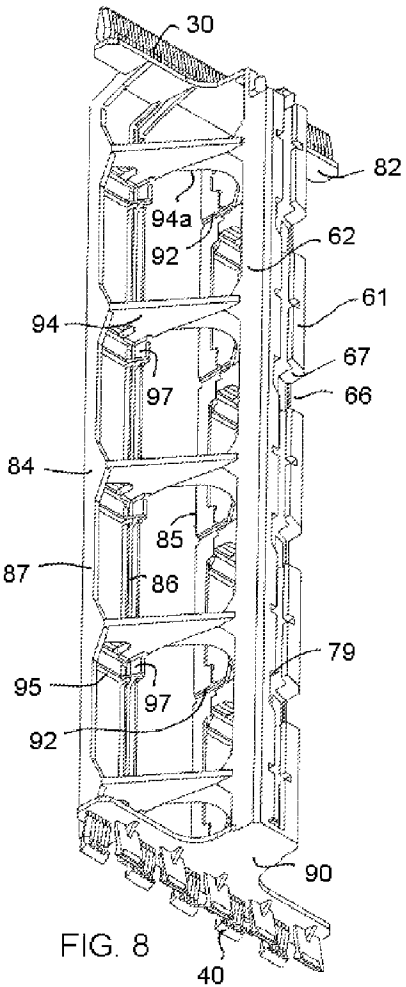
FIG. 8 is a lower perspective view of the retainer of FIG. 7.
Figure 24:
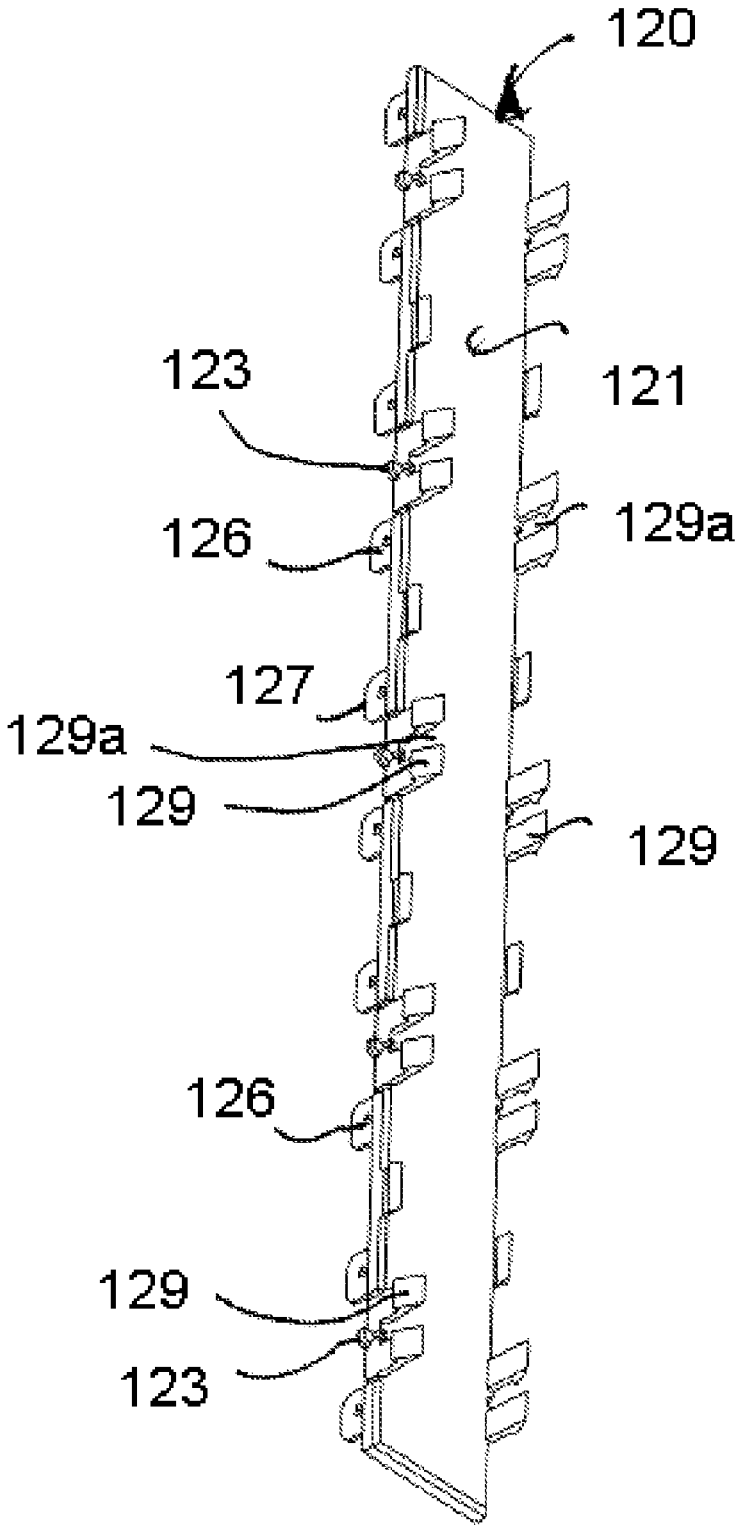
FIG. 24 is a perspective view of a fastening strip connectable to the retainer.

The third main portion of each retainer is a fastening strip 120 (FIGS. 9 and 24). The strip, which can be a discrete component that can be hand or machine assembled to the anchoring portion of the retainer, is designed to receive fasteners such as nails or screws used to fasten wall treatments to the outer surface of panels 7. In one embodiment constructed by the applicant, the fastening strips are 1½ inches wide to emulate the thickness of a conventional 2 by 4 stud.

Connecting portion 60 and anchoring portion 80 of each retainer will typically be injected molded as a single piece.

Figure 10:
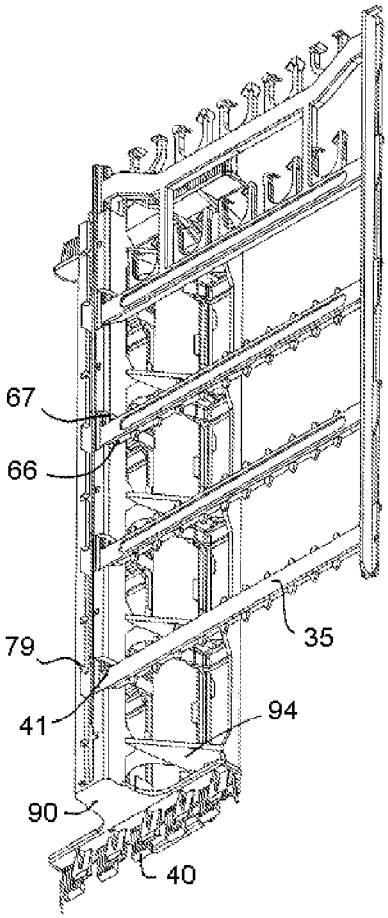
FIG. 10 is a perspective view of the cross web and retainer connected together with a closed or folded over position.
Figure 11:
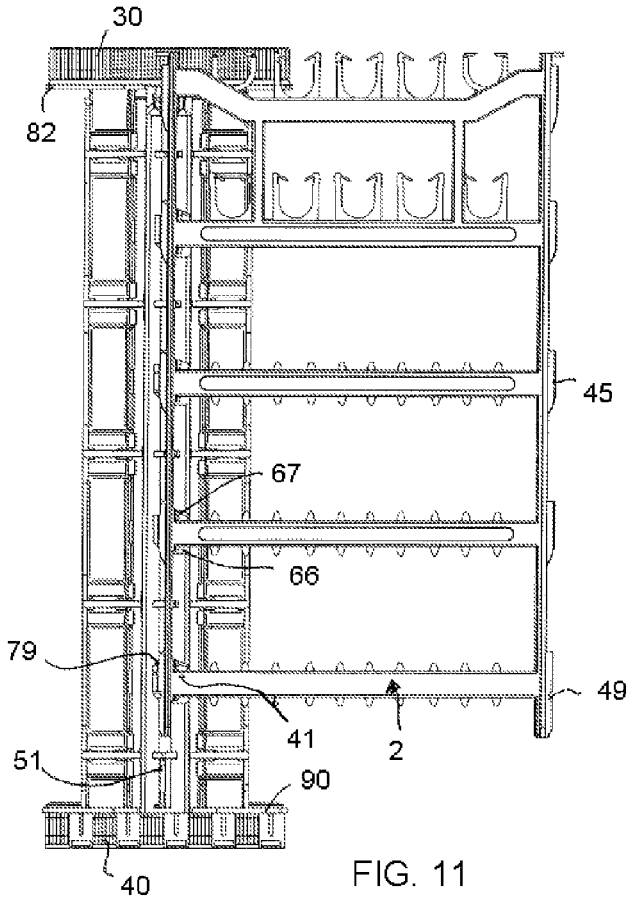
FIG. 11 is a front elevational view of the connected cross web and retainer shown in FIG. 10.

Connecting portion 60 generally comprises two parallel, spaced apart and opposed L-shaped longitudinally extending flanges 61 and 62 which define between them a T-shaped slot 63. Slot 63 is adapted to slidingly receive a respective one of side rails 31 thereinto. As seen most clearly in FIG. 15, slot 63 includes an inner portion 64 which is the head of the T and an outer portion 65 which is the downstroke of the T. Inner portion 64 is large enough to allow side rails 31 to rotate inside the slot so that cross member 2 can pivot between its closed shipping position as shown in FIGS. 10 and 11 and its fully opened position shown in FIGS. 12 and 13. Outer portion 65 of slot 63 is wide enough to slidably but closely receive bead 33 on the inner surface of each side rails 31 thereinto when the cross web is in its fully opened position.

Figure 7:
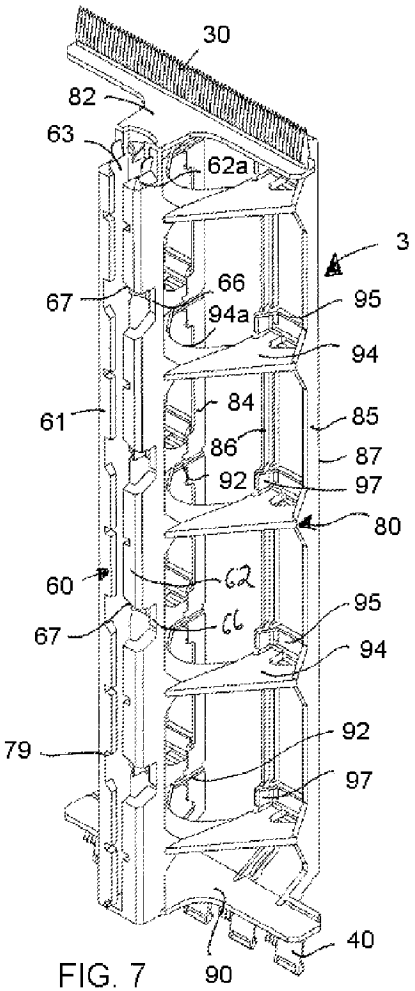
FIG. 7 is an upper perspective view of the retainer.

When looking at the retainer from the front in FIG. 7, the right side flange 61 is formed with a plurality of vertically spaced apart notches 66 that permit the cross web to be folded over 90° into its closed or "shipping" position as shown in FIGS. 10 and 11. There will typically be one fewer of these notches than there are cross members 35. When folded over, the cross webs are not fully inserted into the retainer, so that the uppermost cross member clears the upper end 62*c* of flange 62.

When the cross webs are initially installed into connecting portion 60 of the retainer by sliding side rail 31 into slot 63, the insertion is automatically stopped when detente 41 on the lowermost cross member hits an opposing detente 79 on left flange 61. When this occurs, the cross members are automatically aligned with the respective upper edges 67 of notches 66. The use of detentes 41 and 79 facilitates the automated assembly of the cross webs to the retainers such as by means of robots or other automated equipment.

As the cross web is rotated into its closed position, the downwardly tapering upper edge 67 of notch 66 cams the abutting upper surface of each cross member downwardly so that detente 41 moves to the side and lower than detente 79 as seen most clearly in FIGS. 10 and 11. Accordingly, as the cross web is rotated back into its open position, detente 41 clears below detente 79 so that the cross web can complete its travel to the bottom of the retainer, which terminates when the lower end 34 of side rail 31 hits the surface of bottom plate 90 of retainer 3 as seen most clearly in FIG. 13. Having detente 41 below detente 79 also prevents the cross webs from falling out if opened when upside down.

There are two other camming actions that occur during the closing and then the opening of the cross webs.

Figure 15:
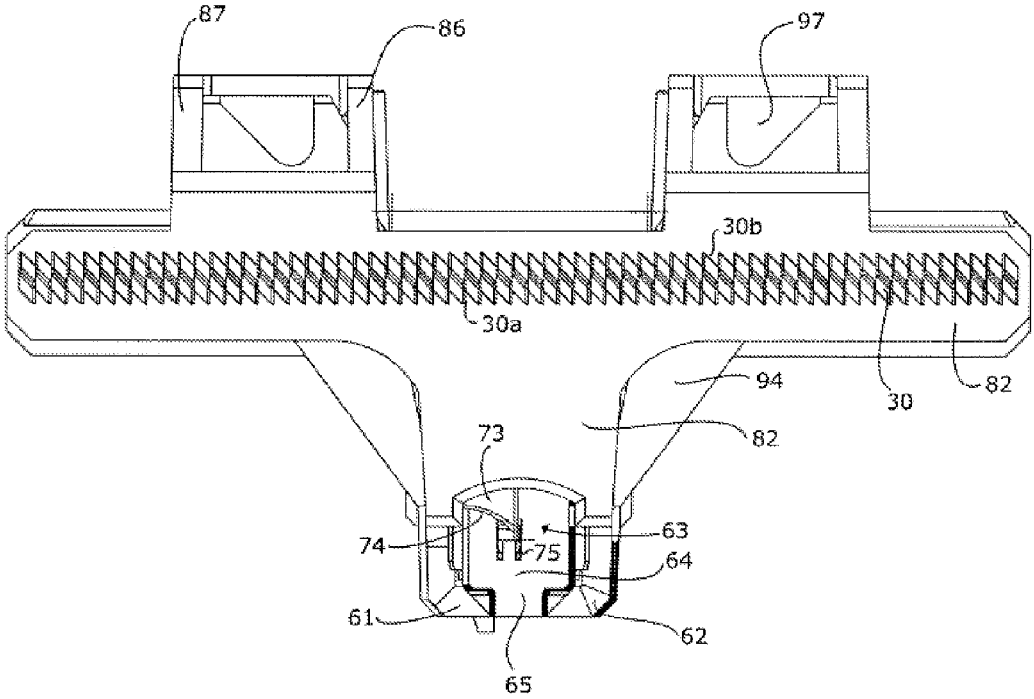
FIG. 15 is a top plan view of the retainer.
Figure 16:
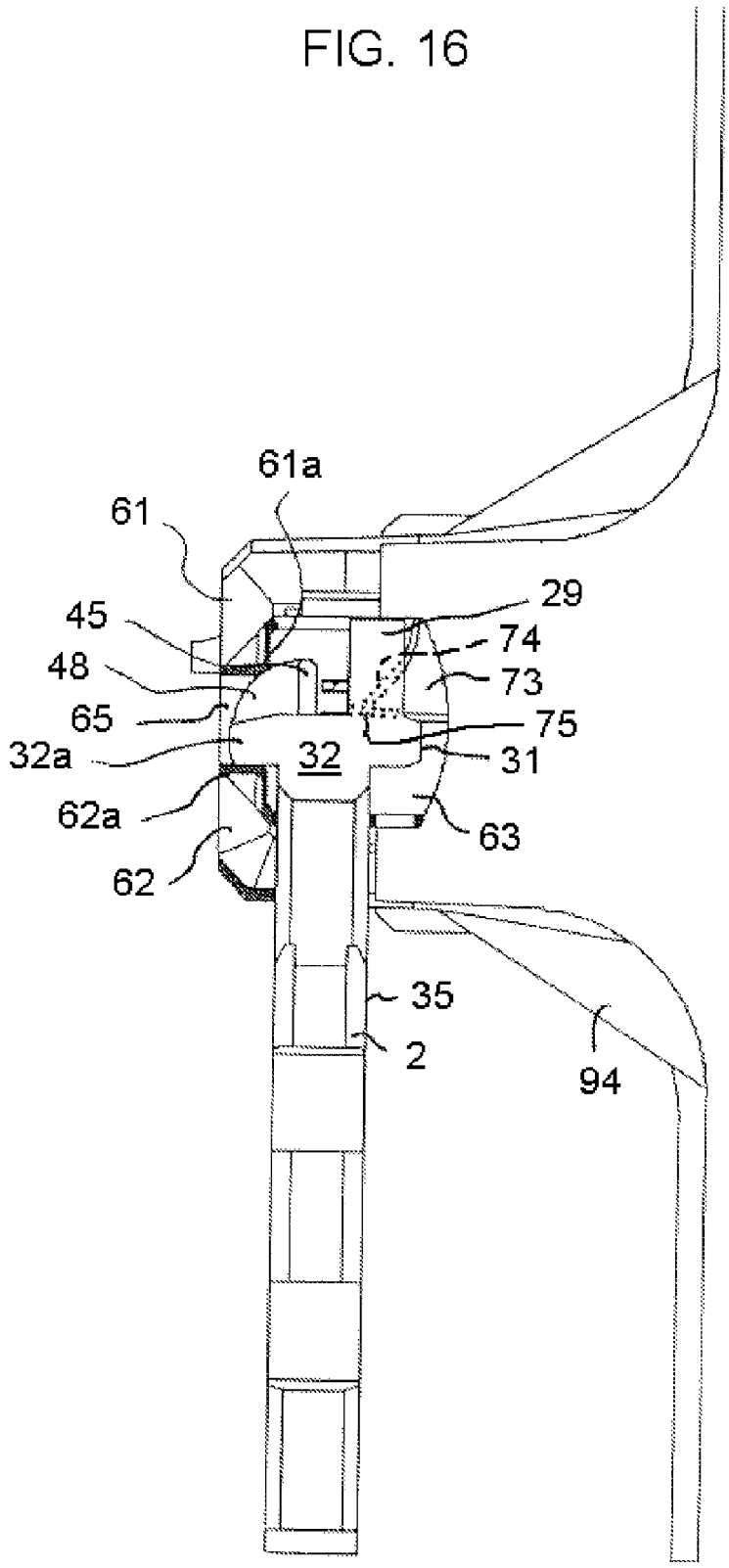
FIGS. 16 to 21 are top plan views showing a movement sequence for the opening of the cross web relative to the retainer.

Referring to FIG. 16, when the cross webs are closed, the quarter circle webs 48 at the upper end of each flange 45 on side rail 31 of the cross webs bears against the inner edge 61*a* of left flange 61 to bias the left side 32*a* of spine 32 against the inner edge 62*a* of flange 62. This prevents the cross webs from wobbling inside the outer portion 65 of slot 63 when folded over. When the cross webs are unfolded into their open position, the second camming action takes place. This action is most clearly illustrated with reference to FIGS. 14 to 20.

Within slot 63, located rearwardly to be horizontally opposite to notches 66 are concavely curved bridges 71 that span the distance between the rearmost vertical edges of flanges 61 and 62. Some of these bridges include a concavely arcuate cam 73 shaped as shown most clearly in FIGS. 14, 15 and 18. In one embodiment constructed by the applicant, cams 73 are formed on every other bridge 71 starting at the top of the retainer so that in the embodiment shown in the drawings, there are three of these cams. Each cam consists of a curved portion 74 and an abutting flange portion 75 although as molded these are a typically seamlessly integrated single component. A greater or lesser number of cams can be used but generally, there should be at least two of them, one adjacent the top of the retainer, and the other adjacent the bottom thereof.

With reference to FIG. 16, with cross web 2 in its fully folded or closed position, it will be seen that there is no contact between flanges 45 on side rails 31 and cams 73, although as described above, web 48 is abutting against the inner edge 61*a* of left flange 61 to bias the left side 32*a* of side rail spine 32 into contact with opposed flange 62.

Figure 17:
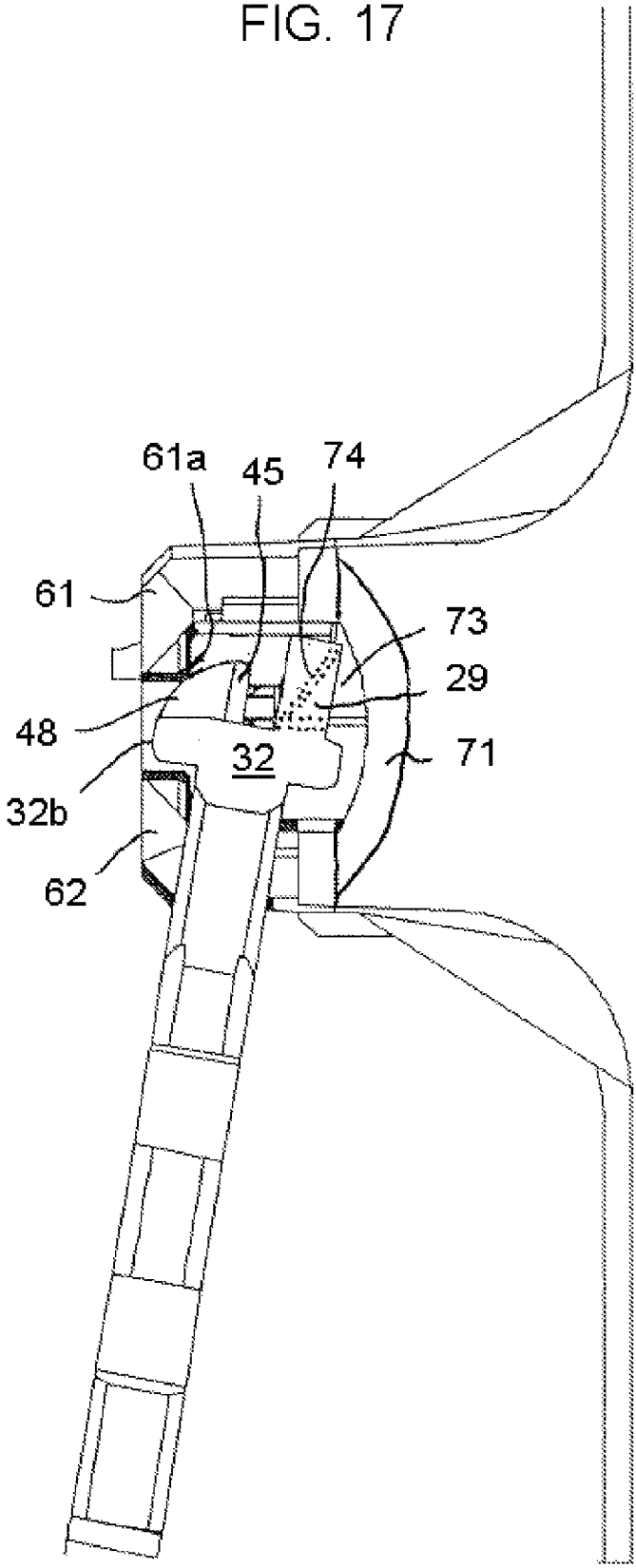
Figure 18:
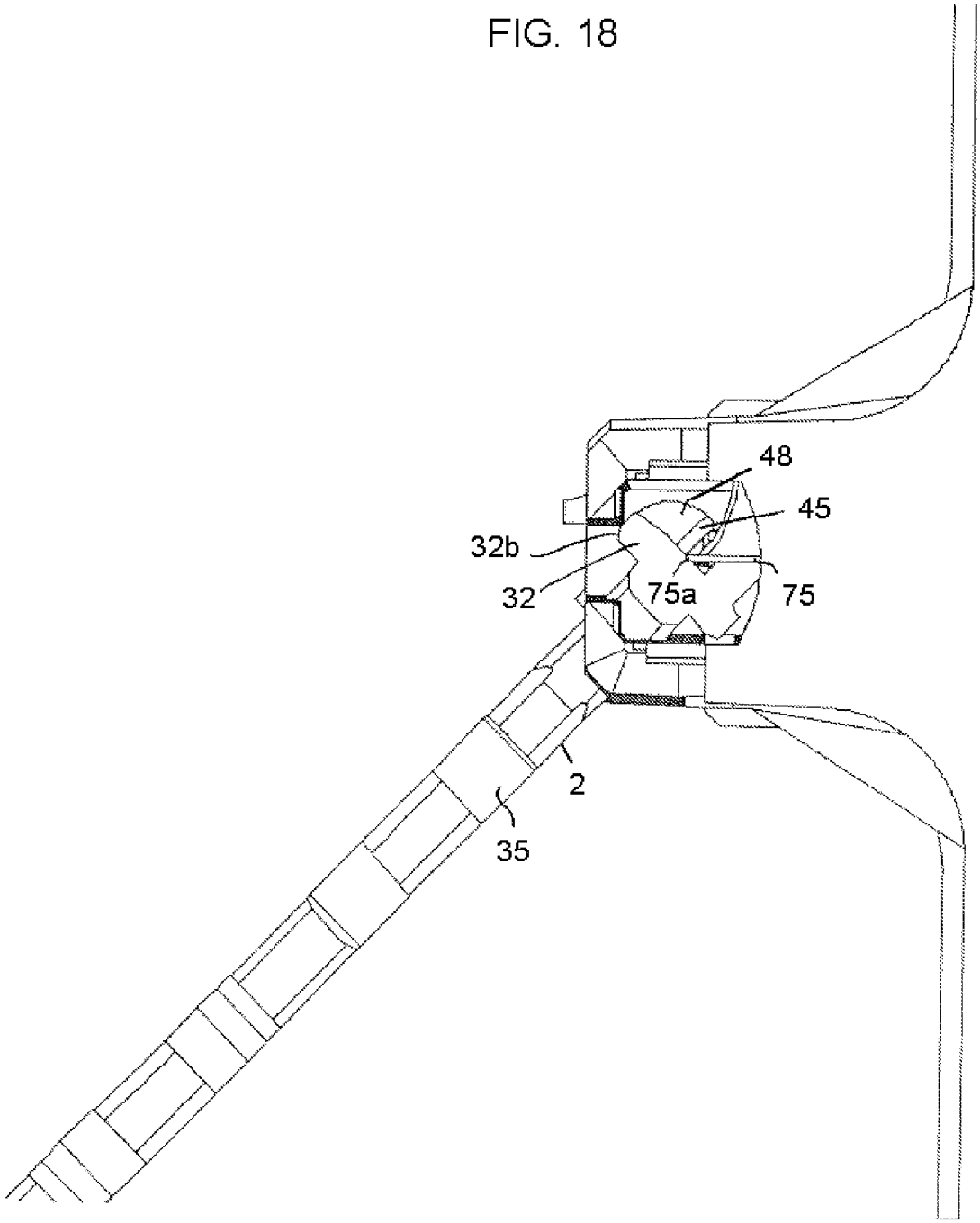

With reference now to FIGS. 17 and 18, as the cross web begins to pivot open, there is initially still no contact between flange 45 and the curved portion 74 of cams 73. However, web 48 and the adjacent edge surface 32*b* of spine 32 continues to bear against edge 61*a* so that the outer edge 75*a* of flange portion 75 contacts the corner between spine 32 and flange 45. This contact becomes the pivot point for additional rotation of the cross member into its open position.

Figure 19:
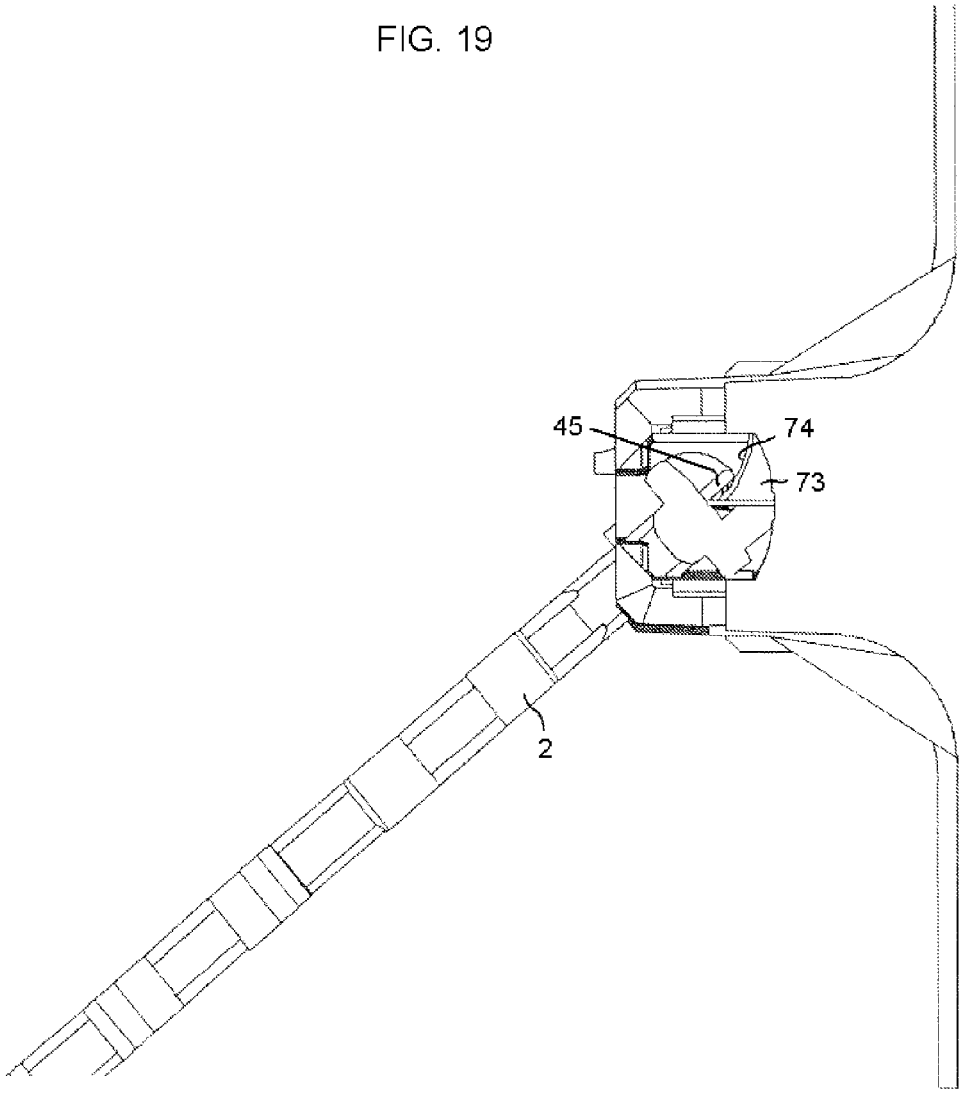
Figure 20:
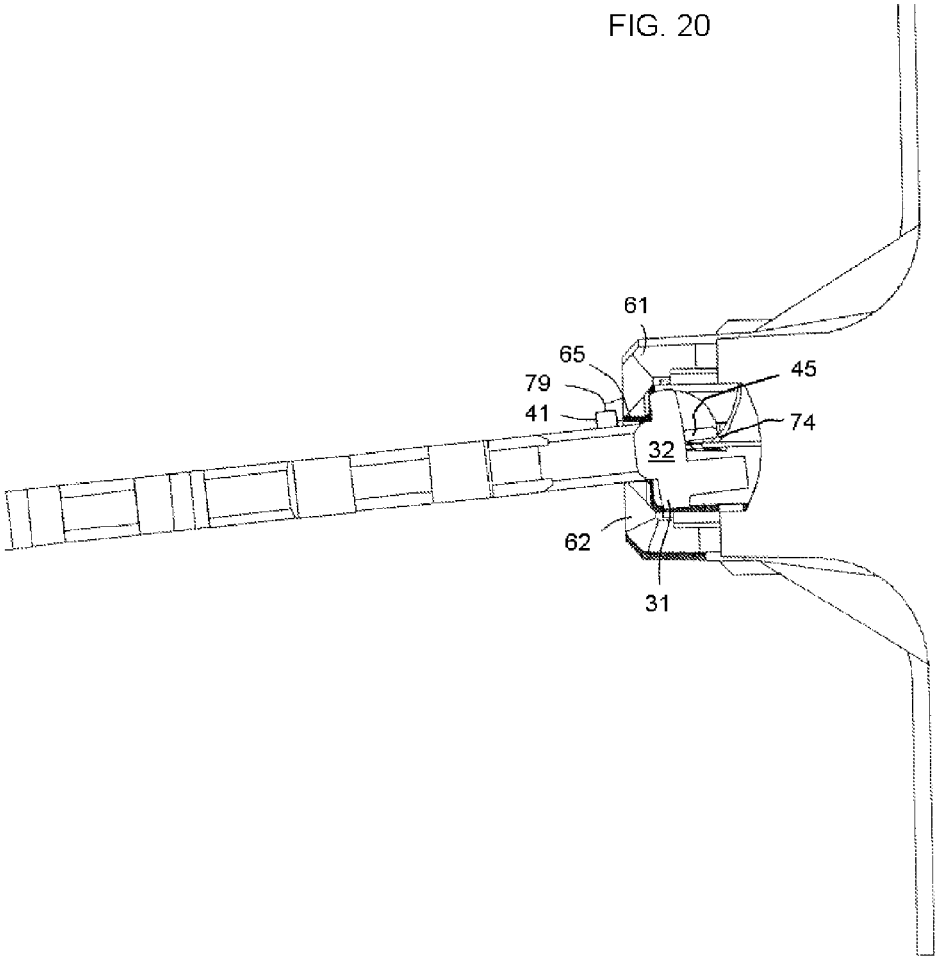
Figure 21:
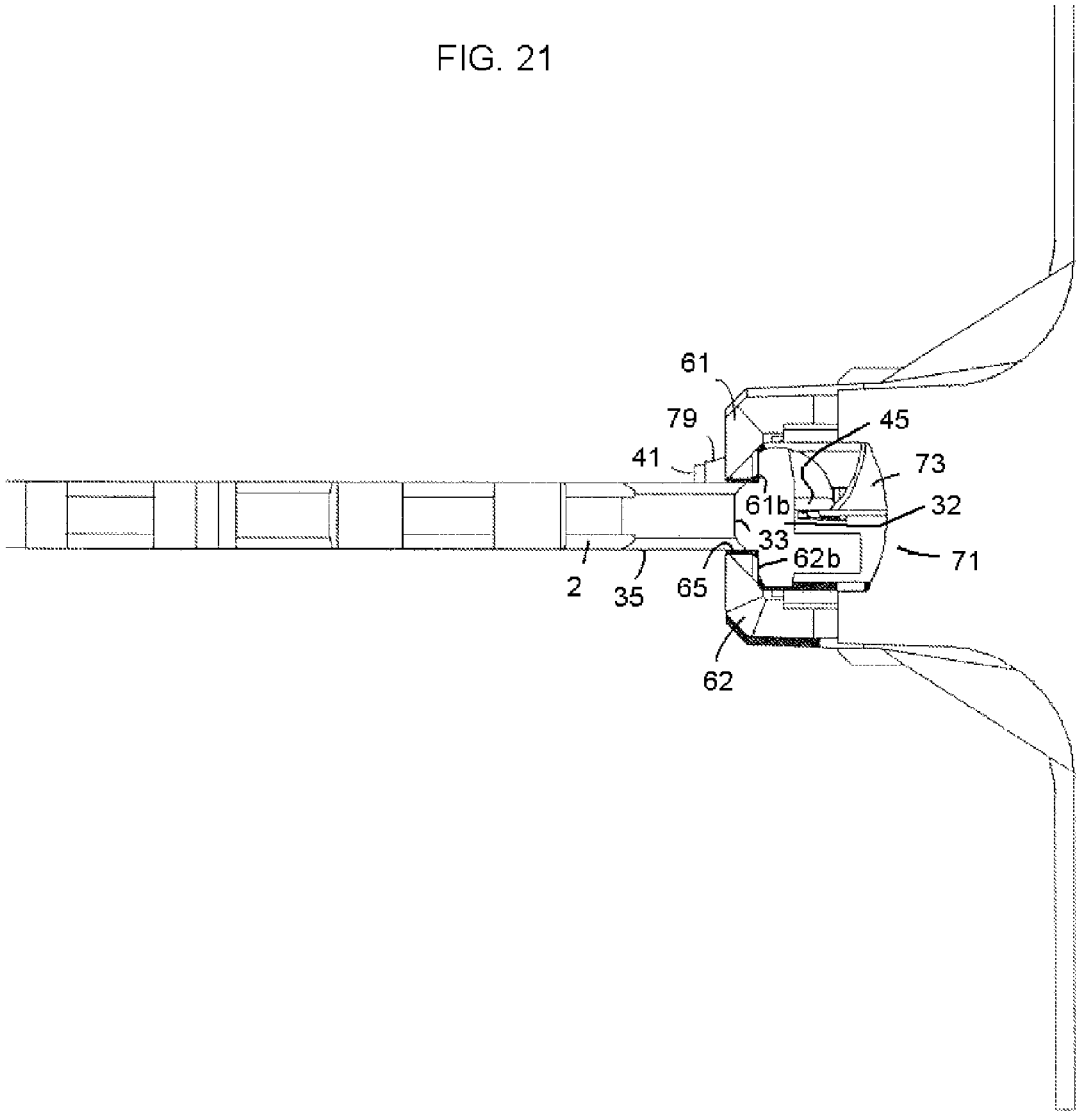

With reference to FIGS. 18 and 19, as the opening of the cross web continues, flange 45 contacts the curved portion 74 of cam 73. As can then be seen in FIG. 20, the contact between flange 45 and cam surface 74 begins to bias the cross web to the left as seen in the figure so that bead 33 of spine 31 begins to enter the slot 65 between retainer flanges 61 and 62. Finally, as best seen in FIG. 21 with cross web 2 in the fully opened position, and cross web 2 fully inserted into retainer 3, the contact between flange 45 and cam 73 fully biases bead 33 and the attached cross member 35 into slot 65 and spine 32 against the inner surfaces 61*b* and 62*b* of flanges 61 and 62.

Figure 12:
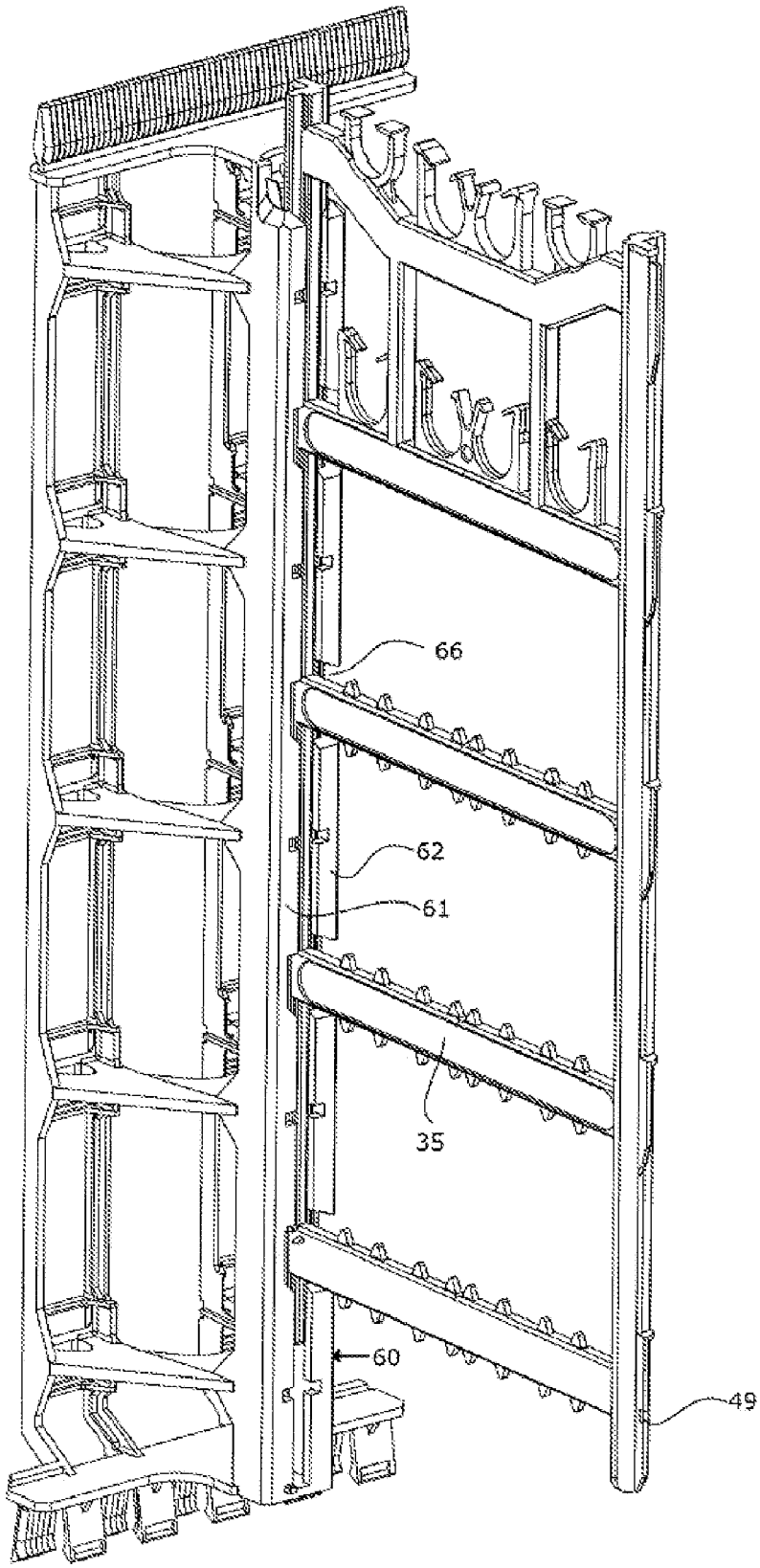
FIG. 12 is a perspective view of the cross web partially inserted into the retainer.
Figure 13:
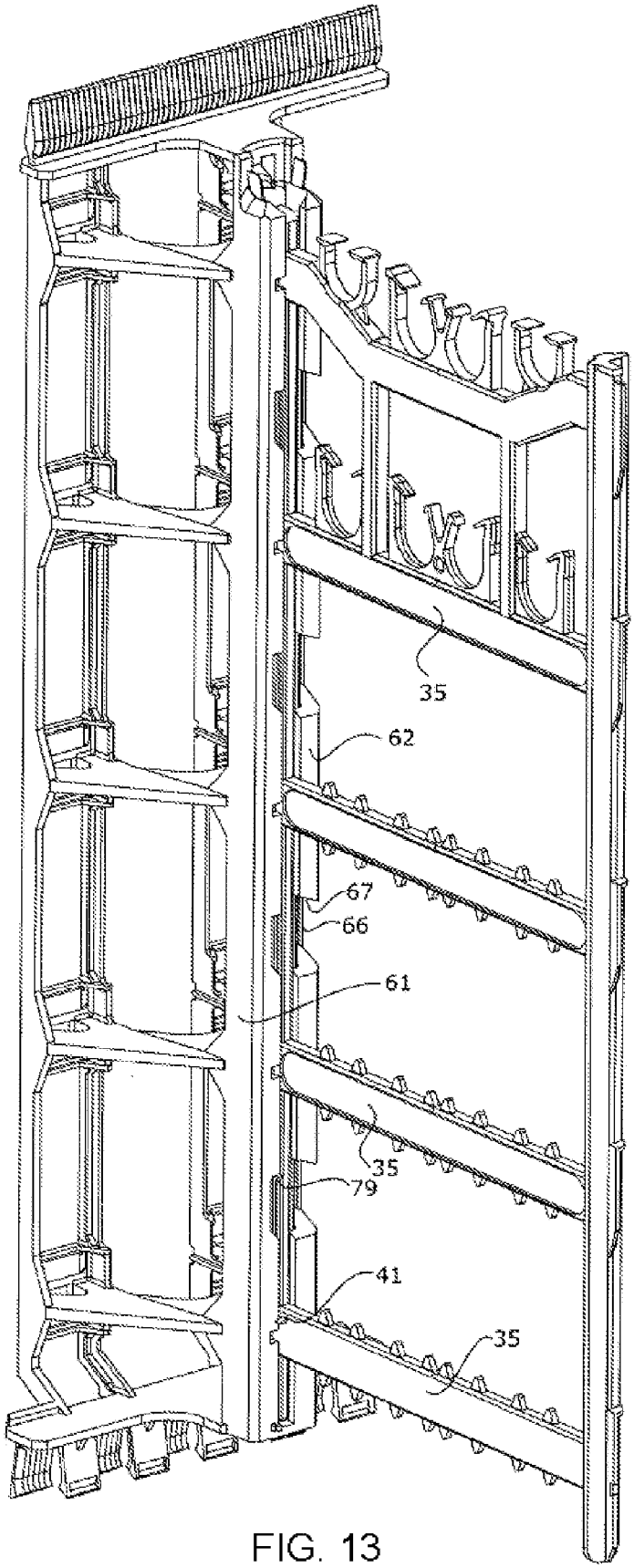
FIG. 13 is a perspective view of the cross web fully inserted into the retainer.
Figure 14:
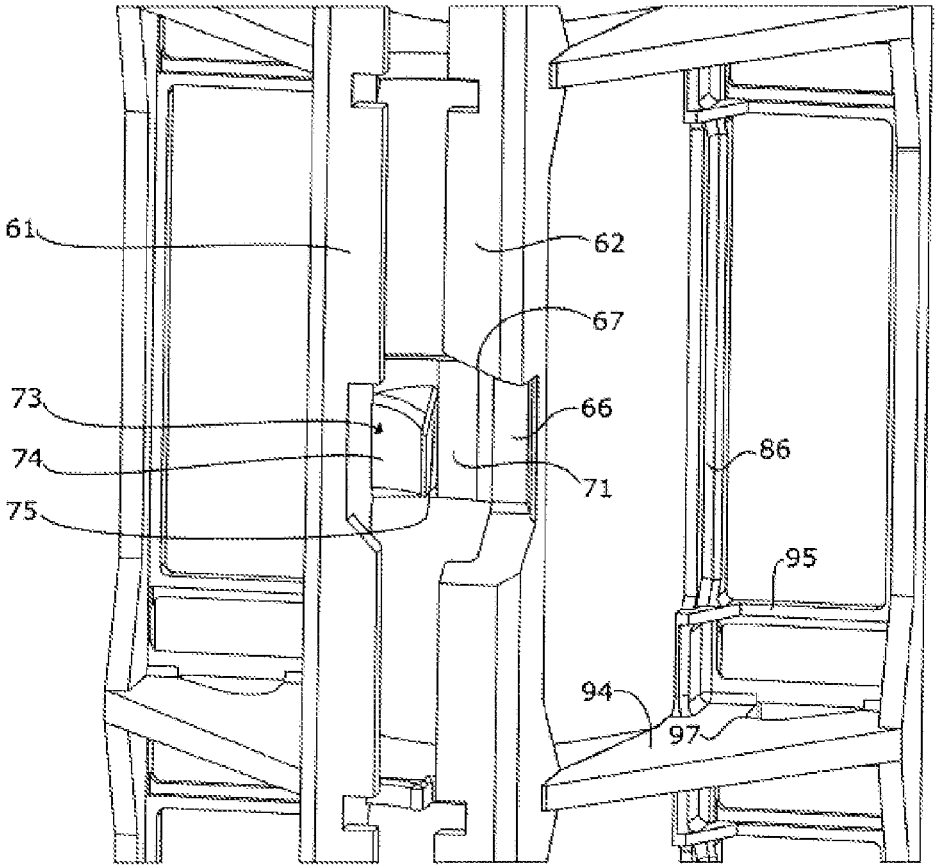
FIG. 14 is an enlarged view of a portion of the retainer showing a cam member therein.

At this point, the lower edge 68 of notch 66 guides the cross web downwardly so that detente 41 on the cross web moves below detente 79 on flange 61, and the cross web is then free to drop into its fully inserted position as shown in FIG. 12. In this position, the cross members 35 are no longer aligned with notches 66, and the cross webs are restrained from moving rearwardly into slot 63 by the continued contact between flanges 45 on side rail 31 and cams 73. The cross webs are therefore locked into the fully opened position, and because the cross webs cannot move rearwardly into slot 63, the width of cavity 6 is dimensionally stable.

If it is desired to close the cross webs, it is merely necessary to pull them upwardly with a sharp tug to unlock the connection between notch 49 and spring tab 51 and lift the cross web until detentes 41 and 79 contact one another so that the cross members are again aligned with notches 66. The cross webs can then be folded back into their closed position. The cross webs can also be removed completely from the retainer by pulling them upwardly as they are again pivoted into the open position so that detentes 49 and 71 clear each other.

Returning now to FIGS. 7 and 8 showing retainer 3, anchoring portion 80 is a framework of structural members integrally formed with and connected to connecting portion 60.

The outer framework of each retainer consists of a generally T-shaped top plate 82, a generally T-shaped bottom plate 90 and a pair of vertically aligned horizontally spaced apart spines 84 and 85 that cooperate with connecting portion 60 to interconnect top and bottom plates 82 and 90. For manufacturing purposes, plates 82 and/or 90 can serve as a rigid ejection surface when molding the EPS panels and then removing them from the molds.

Additional rigidity is provided to the retainer by a plurality of vertically spaced apart horizontal ribs 94 which interconnect connecting portion 60 with spines 84 and 85. The inner edges 94*a* of the ribs are curved inwardly for clearance with fasteners driven through fastening strip 120. These ribs, which can be generally triangular in shape as shown in the drawings, assist in transferring the load from connecting portion 60 to the spines which are fully embedded in foam panels 7. The spines themselves each consist of a pair of spaced apart columns 86 and 87 interconnected by the adjacent rearmost edges of ribs 94 and cross braces 95 which extend horizontally between the columns preferably both above and below the adjacent rearmost edge of ribs 94.

These cross braces 95 provide additional anchoring of the retainer inside the foam panels without at the same time obstructing the large openings between ribs 94 and between the ribs and top and bottom plates 82 and 90 which ensures a generous distribution of the foam inside the anchoring portion so that the foam provides a maximum amount of strength and anchoring. The remaining areas between columns 86 and 87 and braces 95 are open but, if preferred, the spines can be formed as solid webs.

The inside columns 86 of each spine include a plurality of tabs 97 disposed above and below each rib 94. As will be described below, these tabs connect with clips on fastening strip 120 to secure the fastening strip to the retainer.

The shape and configuration of the structural members making up anchoring portion 80 is generally as shown in the drawings although those skilled in the art will appreciate that these can be altered without departing from the principles of the present invention.

As will be seen from the drawings, each of top and bottom plates 82 and 90 respectively support upper and lower connectors 30 and 40. As mentioned above, when the retainers are molded into panel 7, upper connector 30 extends upwardly into channel 13 formed in sealing strips 9, and lower connector 40 extends downwardly into female sealing strip 10 in each panel's lower edge 11.

As will be appreciated, as the blocks are assembled vertically, lower connectors 40 will mate with upper connectors 30 of the blocks immediately below it.

It is preferred that connectors 30 and 40 be as long as practicably possible to minimize the spacing between the connectors on adjacent retainers. This allows more flexibility in the placement of the blocks relative to each other when being assembled together vertically. Accordingly, if the width of retainer 3 is for example 3 inches, the width of top and bottom plates 82 and 90 and the connectors on them can be, for example, 5 inches.

As will be seen most clearly in FIGS. 7 and 15, upper connector 30 is a male saw or ratchet toothed lock. And as seen most clearly in FIGS. 6 and 8, lower connector 40 is a cooperatively shaped female receptor that locks with the upper connector to prevent any lateral movement between the two. Upper connector 30 is double sided, 30*a* and 30*b* with the teeth on each side being oppositely oriented to prevent lateral motion to the left or right. The saw teeth can have a 0.080 inch increment (approximately 2 mm) between them which is small enough to provide for very fine positioning of the blocks along their length. It also reduces the need for the high manufacturing tolerances otherwise required for discrete connections between the blocks. This increment can be selected to be larger or even smaller depending on the level of adjustability required for positioning of the blocks.

Figure 23:
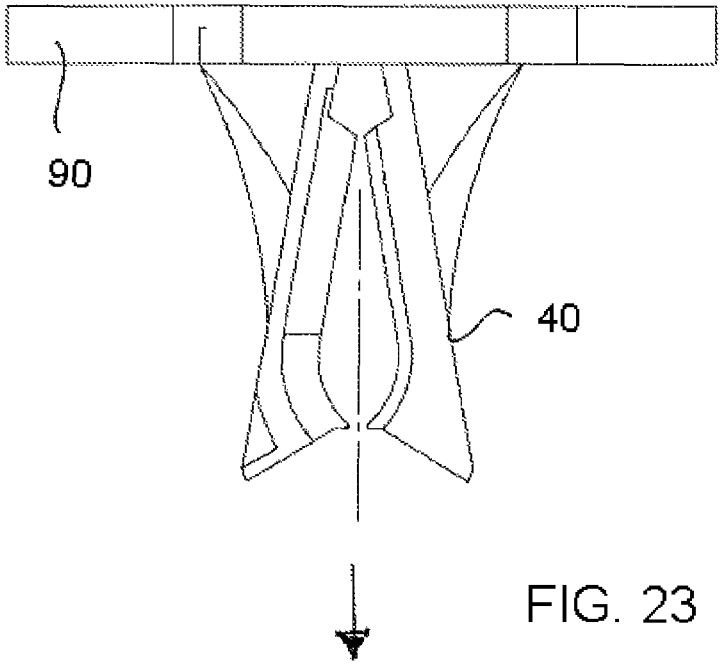
FIG. 23 is a side elevational view of a connector located at the bottom of the retainer.
Figure 22:
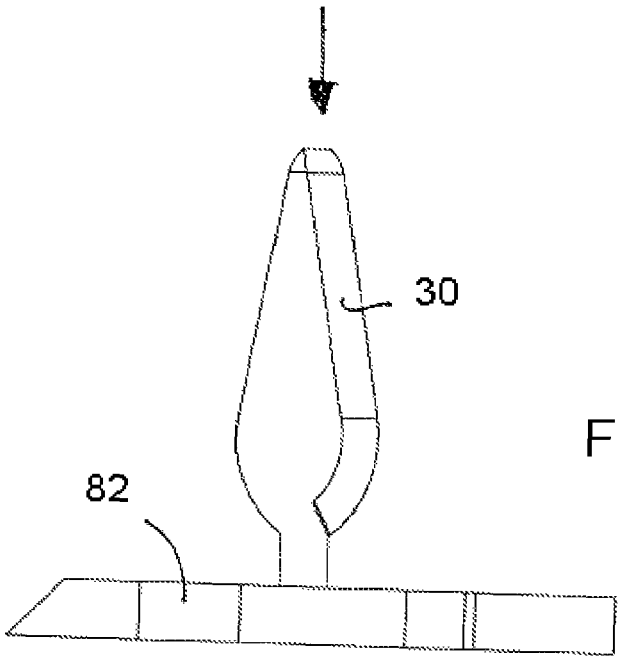
FIG. 22 is a side elevational view of a connector located at the top of the retainer.

As can be seen from FIGS. 22 and 23, upper and lower connectors 30 and 40 are shaped to easily snap fit together but to provide a strong retaining force between them and to prevent unintended separation. This force is useful to overcome the buoyancy and surface tension forces exerted by the concrete poured into cavity 6. As well, both connectors are elevated or spaced away from top and bottom plates 82 and 90 such as by means of stem portions 30*a* and 40*a*. This provides an area where any dirt or debris in the teeth of the connectors can be extruded into, and which also allows for a certain amount of dirt and debris to build up without interfering in the snap fit between the connectors.

Another advantage of the connectors is that each wall formed of blocks 1 now has a solid connection from top to bottom through the rigid non-compressible plastic used to manufacture retainers 3. In the prior art, the blocks have only foam to form mating surfaces, which are not as strong. As well, because the foam is compressible row upon row under the load of concrete, the walls can lack dimensional stability.

As mentioned above, the width of the anchoring portion of each retainer will typically be about 3 inches. If the retainers are on 8 inch centers, the space between adjacent retainers is only about 5 inches, which is superior to prior art constructions. This relatively short spacing between retainers is particularly advantageous in providing superior retention force for tall wall pours.

The third main portion of the retainer is the fastening strip 120 which will now be described in greater detail with reference to FIGS. 9 and 24. As mentioned above, the fastening strips are intended to provide surface that receives nails, screws and the like used to attach wall treatments to the outer surfaces of panels 7.

The fastening strips will typically be injection molded as a discrete component from the same or, if appropriate, a different plastic material than that used to manufacture the rest of the retainer. The strip is rectangular in shape having an inner surface 121 and an outer surface 122 (FIG. 9). Outer surface 122 is formed with a pattern of closely spaced small or even micro pilot blind holes or perforations 124 that extend only partially through the strip. These holes are closely spaced enough that the greater likelihood is that any penetrating fastener will enter one of them which will help prevent cracking or crack propagation as the nail or screw is fully inserted, particularly in cold weather. The perforations will also help to limit the "volcanoing" or extruding effect that occurs when driving a nail or screw into a polymer.

A series of perpendicular tabs or stand offs 126 extend rearwardly from opposite vertical edges of the fastening strip. The outer edges 127 of these tabs will be slightly recessed below the outer surface of panel 7, or they might be flush to the outer surface. Either way, the tabs provide a visual indication of the precise location of the fastening strip. The edges of the tabs won't interfere with the application of stucco or other spread or sprayed treatments to the panels, and they also serve as firm standoffs for attaching drywall or other sheet-type finishes. The firm support provided by these tabs helps prevent excessive compression of the drywall into the EPS which in turn helps to prevent nail or screw popping.

Finally, each fastening strip will include a plurality of spring tabs 129 located to snap fit over tabs 97 on columns 86 to securely connect the fastening strips to the anchoring portion 80 of each retainer. The use of spring tabs allows the automated (robotic) assembly of the fastening strip to the retainer prior to the placement of the retainers into the panel molds (not shown). To assist in connecting the fastening strip, retainer 3 can include vertically spaced apart, horizontally parallel guides 92 seen most clearly in FIGS. 7 and 8. These guides are sized to engage the gap 129*a* between pairs of spring tabs 129 for easier positioning of the fastening strip prior to being snapped home. These guides can also bear or transfer to the retainer some of the vertical loading that might be placed on the fastening strip. Tabs 123 extending laterally from the vertical sides of the fastening strip "stop" the insertion of the fastening strip into the retainer and can also distribute some of the loading transferred to the fastening strip during insertion of fasteners.

The present ICF is adaptable for the formation of corners and T-intersections using the same components described above together with a few additional ones that will now be described in greater detail.

Figure 25:
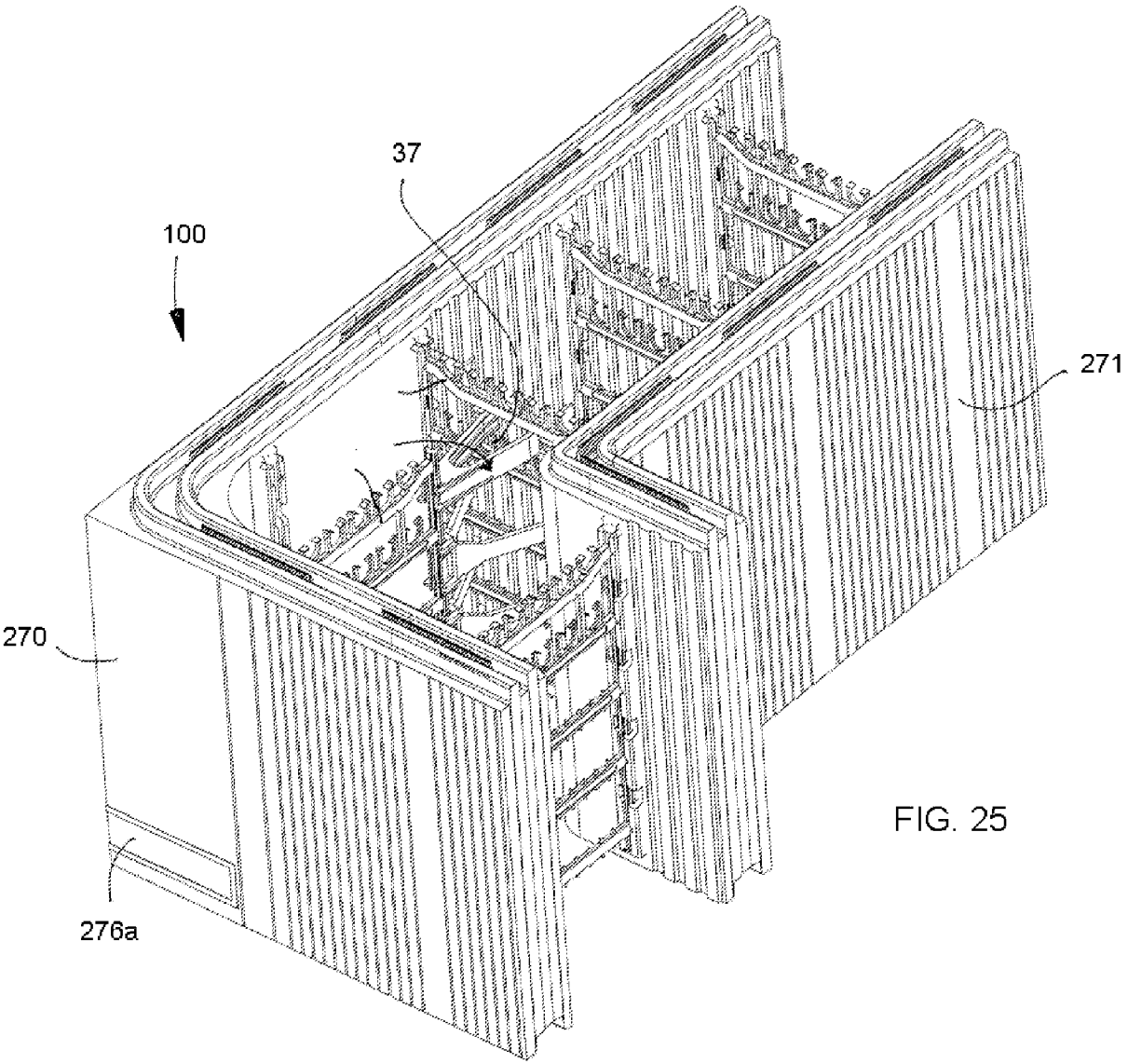
FIG. 25 is a perspective view of a right angled corner block for the present ICF.

Reference is initially made to FIGS. 25 and 26, wherein like numerals have been used to identify like elements, showing a 90° corner block assembly 100. The corner block utilizes the same retainers 3 and cross webs 2 disclosed above.

Each corner block includes an outer EPS panel 270 and an inner EPS panel 271, both formed with 90° elbows and both having a minor leg and a major leg, which will be reversed for the next vertically adjacent row of panels for proper brick-pattern staggering between the rows. There will also of course be left and right hand versions of the panels. Panels 270 and 271 are otherwise the same as panel 7 described above with the exception of the addition of a corner anchor 275 which will be described below.

In the bend between the inner and outer panels, the innermost cross web 2*a* is tied to the next orthogonally adjacent cross web 2*b* by means of a T-web 225. This increases the strength of the block at the corner and reduces the deflection of panel 270 due to the pressure of the concrete. The T-webs will be molded from polypropylene but other materials, metal or plastic, can be used as will be apparent to the person skilled in the art.

Figure 28:
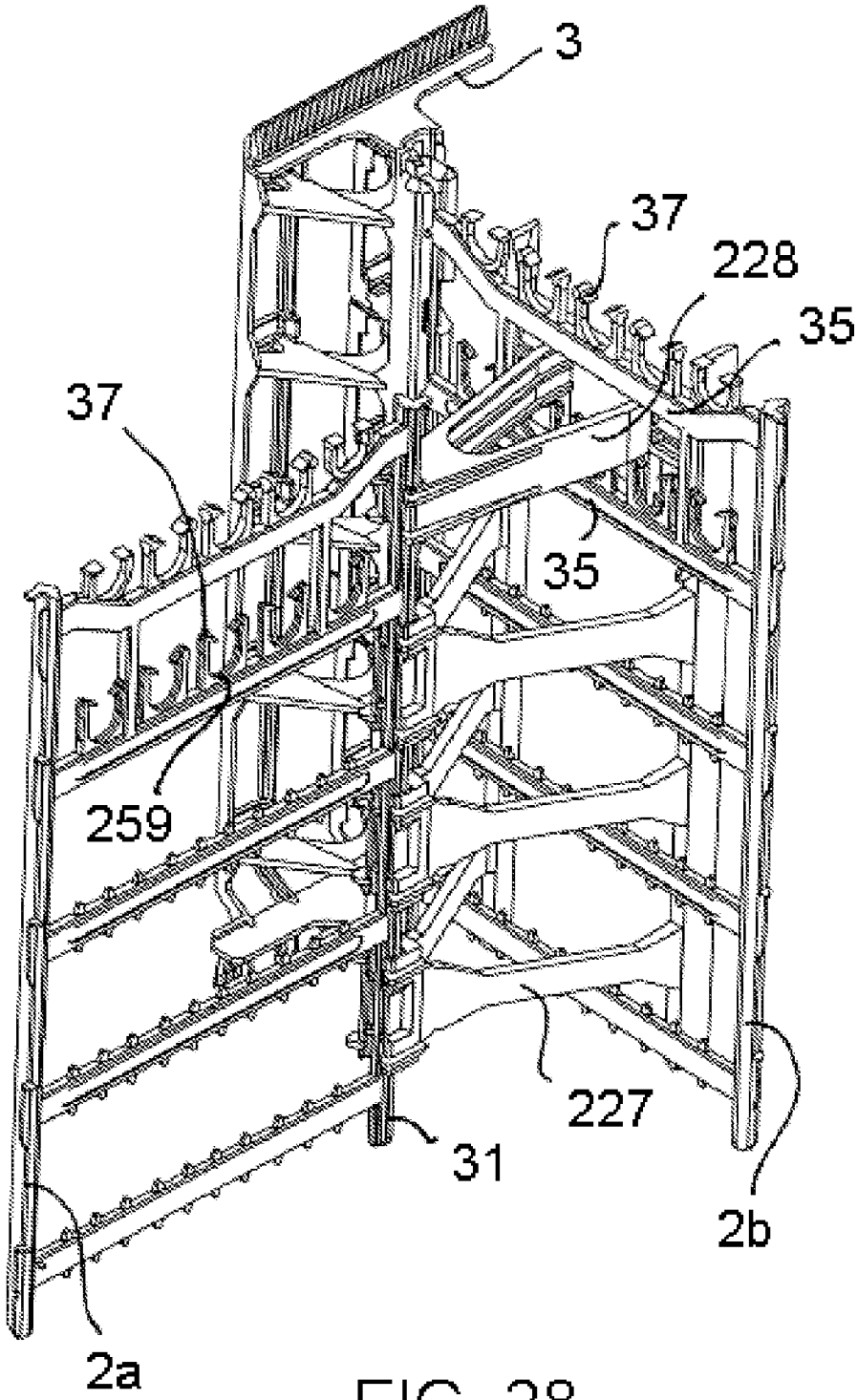
FIG. 28 is a perspective view of the retainer, cross web and T-web forming a corner block assembled together.

With reference to FIGS. 26, 27 and 28, the T-web is intended to be inserted through cross web 2*b* from its far side relative to cross member 2*a* so that its arms 227 pass through the horizontal openings between cross members 35. The T-web's upper arm 228 is shaped differently than lower arms 229 to allow it to clear rebar clips 37. Each lower arm 229 consists of a horizontally extending A frame 230 that connects at one end to parallel, spaced apart uprights 235 and at the other end to a guide head 232. Upper arm 228 consists of a narrower angle A frame 236 that connects to a crossing member 237 that extends horizontally between uprights 235.

Each guide head 232 and the outer end of upper arm 228 is formed with a slot 246. Slots 246 are vertically axially aligned and are shaped to slidingly receive side rail 31 of cross web 2*a* therethrough. The shape of the slots include a quarter circle cut out 248 that provides clearance for quarter circle webs 48 on flanges 45. The exception to this is the lower surface 239 of lowermost guide head 232 which, as shown most clearly in FIG. 27, lacks this cut out so that the contact with web 48 at this point will automatically stop further insertion of the cross web into the guide heads. This ensures that cross web 2*a* will be level with the adjacent cross webs. It will be seen as well that slots 246 are aligned in the same vertical plane as receiving portion 60 of the next downstream retainer 3 so that cross web 2*a* can be the same width as all other cross webs in the ICF for standardization.

Uprights 235 are sufficiently long to straddle all five cross members 35 of cross web 2*b*. Each upright includes a pin 250 and crossing member 237 also includes a pin 251 at its mid point between the uprights. As best seen in FIG. 28, when the T-web is assembled to cross web 2*b*, the three pins serve to center and vertically hold the T-web in place. In this regard, pin 251 engages a small groove 254 in the lower surface of rebar clip 37 on the second cross member from the top, and pins 250 pinch under the same cross bar. Pins 250 can be chamfered on their upper edges as shown to facilitate their insertion. The T-webs will work with cross webs that are 6 inches or larger in width.

As will be seen most clearly in FIG. 27, the guide heads and upper arm 238 include reinforcing ribs 262 for added strength against the force of the poured concrete.

Figure 29:
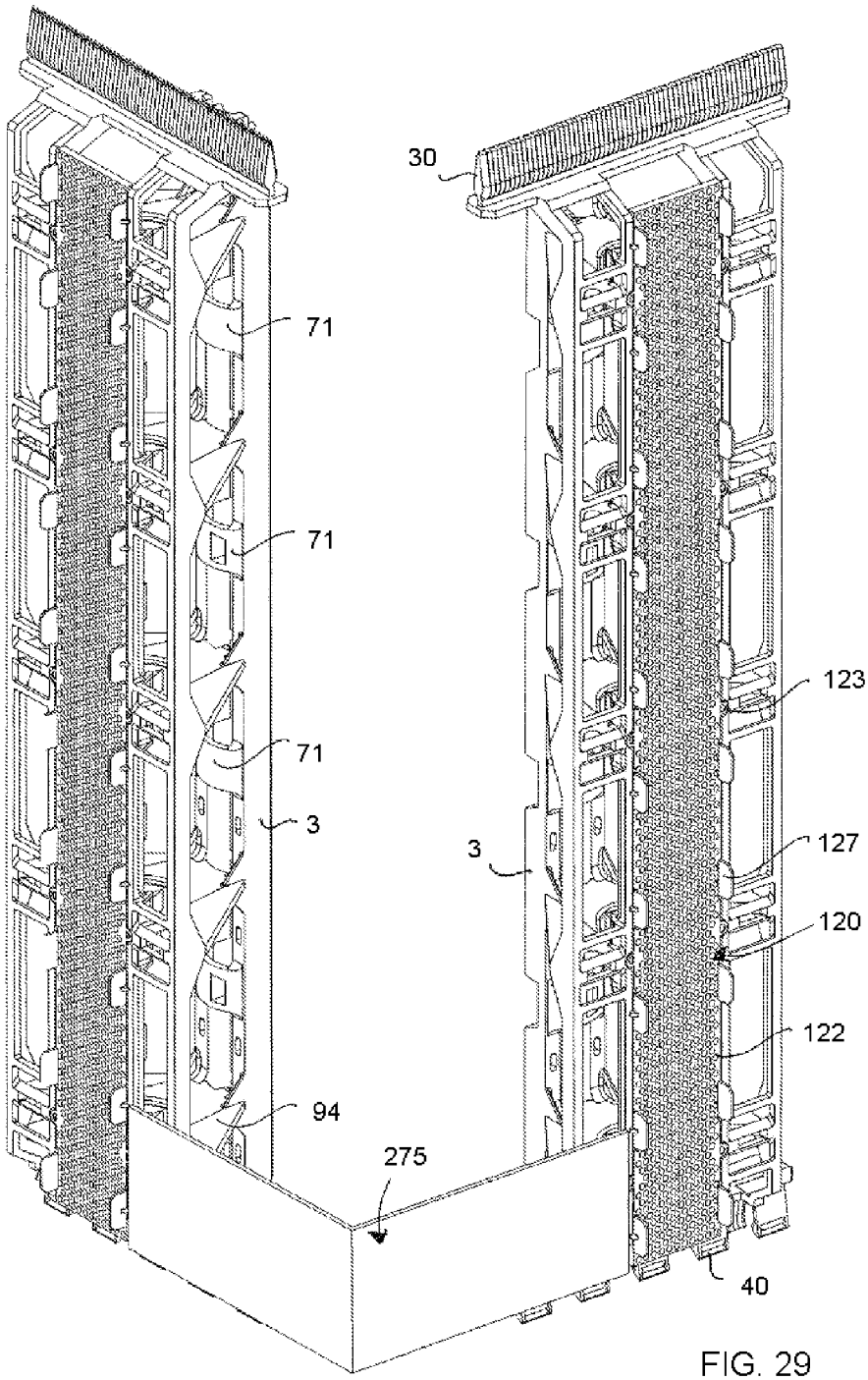
FIG. 29 is a rear perspective view of a corner anchor assembled to a pair of retainers.
Figure 30:
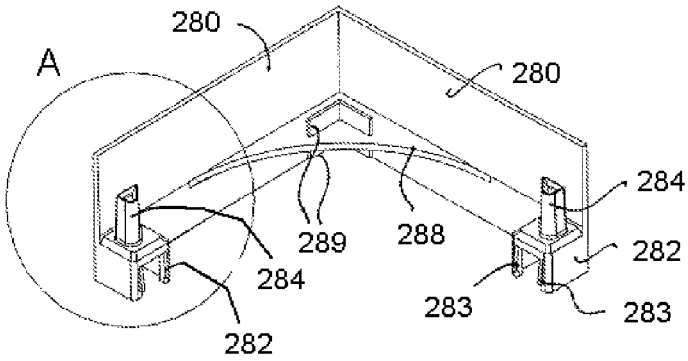
FIG. 30 is a front perspective view of the corner anchor shown in FIG. 29.
Figure 31:
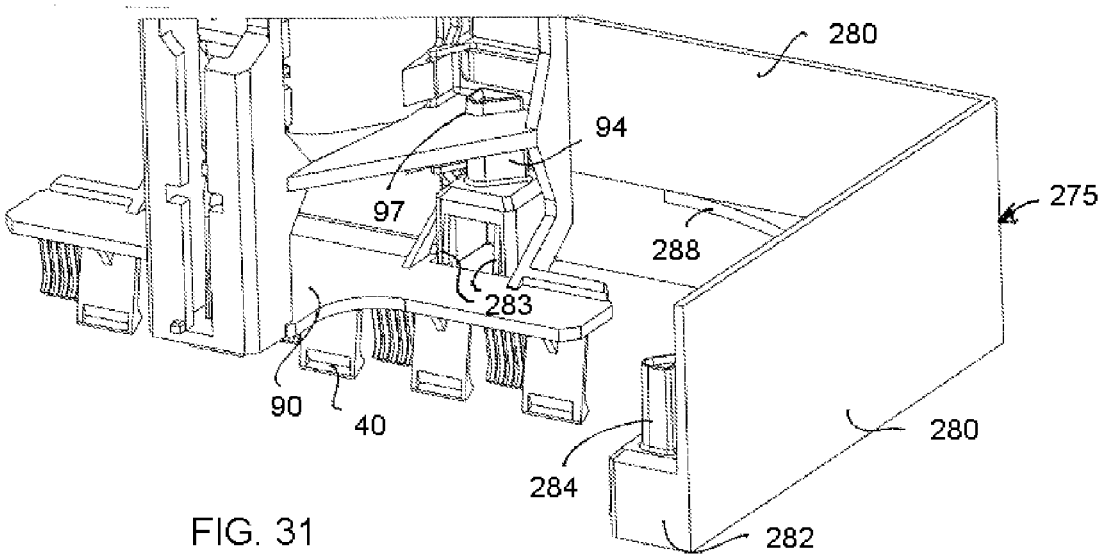
FIG. 31 is a perspective view of the corner anchor assembled to one of the retainers.

Reference will now be made to FIGS. 29, 30 and 31 which illustrate a corner anchor 275 used to strengthen the outside elbow of the 90° corner block and which also serves as a fastening strip for the connection of wall treatments. This part can also be made from polypropylene or other suitable materials.

As will be seen initially in FIG. 29, corner anchor 275 connects with the two retainers 3 closest to the actual corner. Since the spacing of the retainers will vary depending upon the width of cross webs 2, the corner anchors will be made in corresponding 4, 6, 8 and 10 inch sizes. The rear surface 276 of the corner block will be recessed relative to the outer surface of outer panel 270 and a silhouette 276*a* can be projected onto the outer surface for a precise visual indication of its location, as can be seen from FIG. 25.

Referring to FIG. 30, the corner block includes orthogonally extending walls 280, the outer end of each wall being formed with a pedestal 282 with each pedestal including a prismatically-shaped vertically upright peg 284. These pegs are shaped to slide into correspondingly shaped notches 97 in horizontal ribs 94 of retainers 3. When molding the panels, the retainers can be positioned first and the corner anchors can simply be inserted into notches 97 in the retainers. When insertion is complete, detentes 283 on pedestals 282 engage over lower retainer plate 90 to provide additional support for externally applied loads. This simplified connection facilitates automation of the process. To add strength to the corner block, a reinforcing web 288 can be added, including chevrons 289 to more securely anchor the corner block into the EPS.

Figure 32:
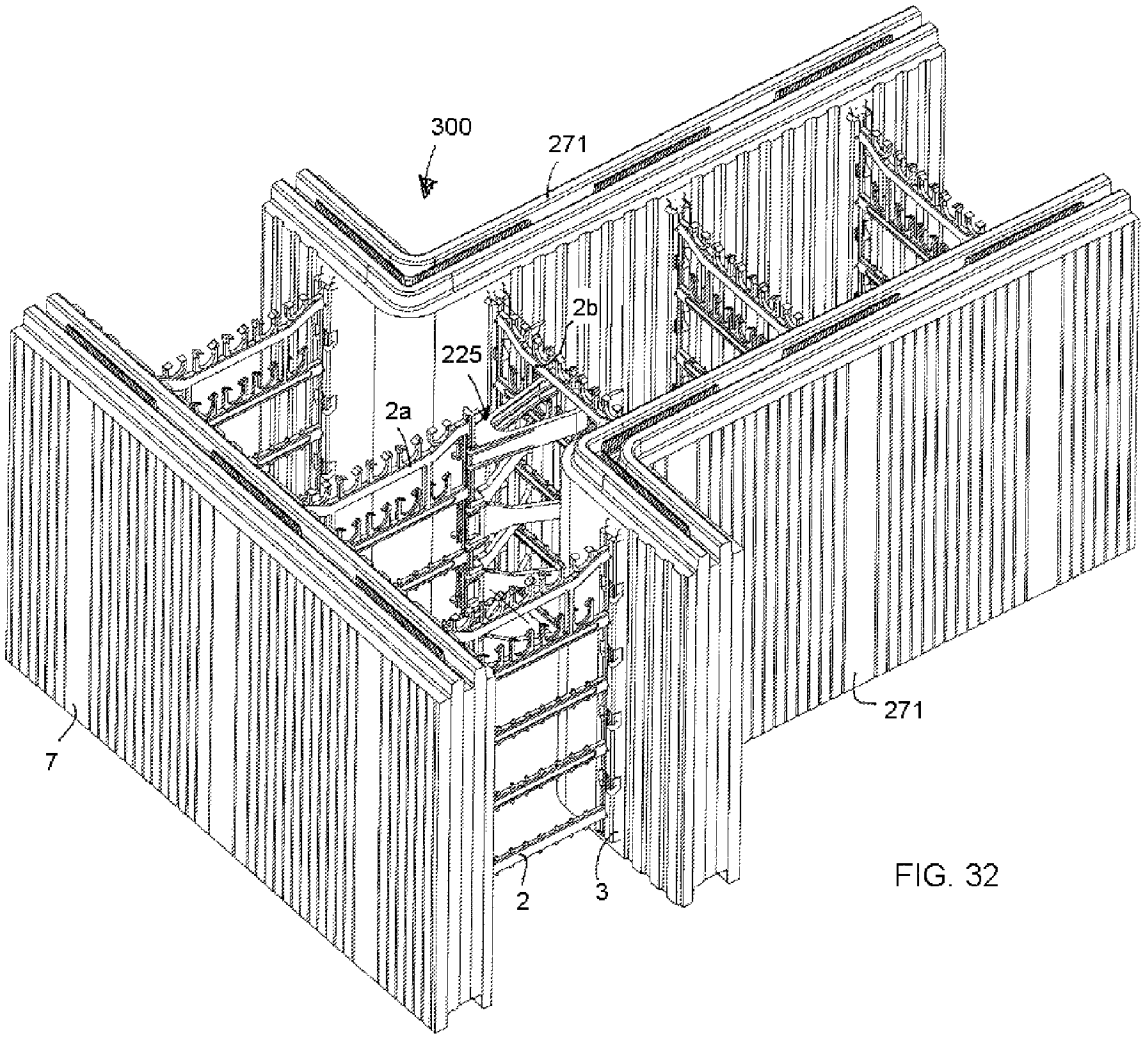
FIG. 32 is a perspective view of a T-intersection block, short form.
Figure 33:
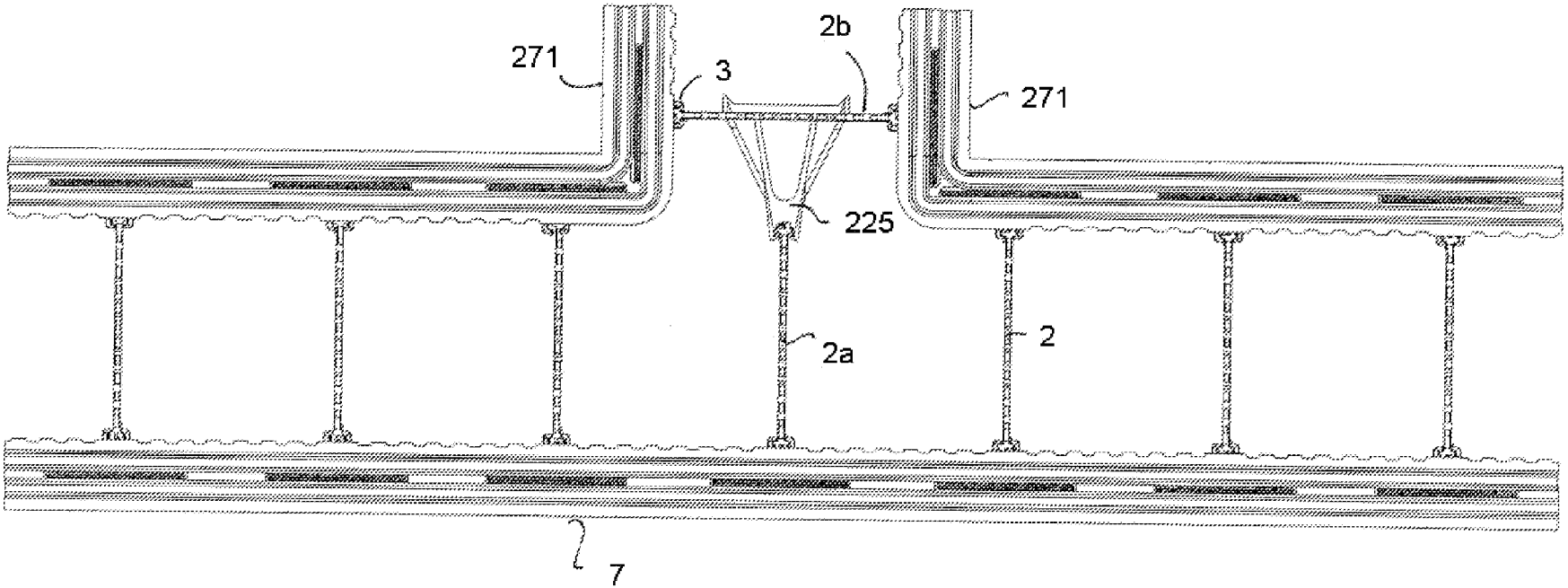
FIG. 33 is a plan view of a T-block in its long form.

Reference will now be made to FIGS. 31 and 32 showing a T-intersection block 300. Like numerals have been used to identify like elements. As will be seen, the T-block is substantially the same as the corner block except that it extends in both directions. Otherwise, it uses the same retainers, cross webs and T-webs, although without corner blocks 275. As in the corner blocks, the T-webs strengthen the block at the T-intersection and reduces the deflection of panel 7 due to the pressure of the concrete. For proper staggering between rows, FIG. 31 shows the "short" version of the T-block, while FIG. 32 shows the "long" version. Their use will alternate between rows. By using cross webs of different widths, the T-blocks can be readily configured for wall thickness transitions. For example, the wall forming the head of the T can be 8 inches thick while the perpendicular wall can be 6 inches thick

INDUSTRIAL APPLICABILITY

The ICF described above is useful in the formation of concrete wall structures complete with integrated insulating panels.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

The invention claimed is:

1. Apparatus for a concrete form for an insulated wall, comprising:

first and second wall panels arranged in opposed spaced apart parallel relationship, each panel having an inner surface, an outer surface, an upper edge surface, a lower edge surface and end surfaces;

a plurality of retainer means secured within each of said first and second panels at spaced apart intervals, each retainer means including a connecting portion extending outwardly from said inner surface of each of said panels, and an anchoring portion including:

a framework disposed within said panels;

an upper connector extending upwardly from each panel's upper edge surface and having a predetermined length which extends in the longitudinal direction of each panel's upper edge surface;

a lower connector extending downwardly from each panel's lower edge surface and having a predetermined length which extends in the longitudinal direction of each panel's lower edge surface, said upper and lower connectors being adapted to respectively engage selected ones of the upper and lower connectors of the next vertically adjacent panel to securely attach said panels together, one of said upper and lower connectors being a male configured component and the other of said upper and lower connectors being a female configured receptor for receiving said male configured component thereinto for the prevention of both vertical and lateral separation of said panels, said male configured component comprising a plurality of teeth extending along the length thereof and said female configured receptor being cooperatively formed to engage some or all of said teeth to prevent lateral movement of said connectors relative to one another, said teeth having a ratcheted configuration; and a plurality of cross webs extending between said first and second panels to tie them together, said cross webs being adapted for respective connection to the connecting portion of opposed retainer means in said first and second panels.

2. The apparatus of claim 1 wherein said male configured component has first and second longitudinally extending sides with said teeth on both of said sides, the teeth on said first side being oppositely oriented to the teeth on said second side which, when said teeth are connected to said female configured receptor, prevents lateral left or right movement of said connectors relative to one another.

3. The apparatus of claim 2 wherein the spacing between said teeth on each of said first and second sides is about 0.08 inches.

4. The apparatus of claim 1 wherein said female configured receptor can engage a selected number of said teeth for adjustment to the relative longitudinal position of said female configured receptor to said male configured component.

5. The apparatus of claim 1 wherein said male configured component is said upper connector.

6. The apparatus of claim 5 wherein said male configured component is supported in vertically spaced apart relationship to said upper edge surface of each panel to provide clearance between said teeth and said upper edge surface.

7. The apparatus of claim 1 wherein said upper edge surface of said panel includes a pair of parallel spaced apart longitudinally extending sealing strips that define a continuous channel therebetween, said upper connector of each retainer means being disposed in said channel.

8. The apparatus of claim 7 wherein said lower edge surface of each of said panels is formed with a longitudinally extending channel therein which is sized to sealingly engage said sealing strips on the upper edge surface of a vertically adjacent panel.

9. The apparatus of claim 8 wherein the continuous nature of said channel defined between said pair of sealing strips facilitates the cleaning of extraneous matter from said channel.

10. The apparatus of claim 1 where each of said plurality of cross webs comprises a pair of parallel, spaced apart side rails, each side rail having an upper end and a lower end, and a plurality of cross members extending orthogonally between the side rails at spaced apart intervals.

11. The apparatus of claim 10 wherein said connecting portion of said retainer means defines a longitudinally extending slot having an open upper end and a closed lower end, said slot being shaped to slidably receive a respective one of said cross web side rails thereinto through said open upper end to connect the two and to prevent lateral separation therebetween.

12. The apparatus of claim 11 wherein said side rail is selectively rotatable within said slot between an open position in which said cross web extends orthogonally relative to said panels, and a closed position in which said cross web folds parallel relative to one of said panels.

13. The apparatus of claim 12 wherein said slot in said connecting portion includes a plurality of notches formed to one side of said slot at spaced apart intervals equal to the spaced apart intervals between said cross members of said cross web, wherein alignment of one or more of said cross members with a corresponding number of said notches allows said cross web to rotate from its open to its closed position.

14. The apparatus of claim 13 wherein non-alignment between said cross members and said notches prevents rotation of said cross web into its closed position.

15. The apparatus of claim 14 wherein said connecting portion of said retainer means and said cross web have cooperating means thereon that stop the insertion of said side rail into said slot at a predetermined point where some of said cross webs are aligned with respective ones of said notches to permit rotation of said cross web into its closed position.

16. The apparatus of claim 15 wherein said cooperating means comprise a first stop member on an outer surface of said connecting portion and a second stop member on one of said cross members, said first and second stop members being positioned to contact one another when said side rail is inserted into said slot to said predetermined point, which automatically aligns some of said cross members with respective ones of said notches.

17. The apparatus of claim 16 wherein said notches are shaped to guide said cross web downwardly relative to said connecting portion as said cross web rotates into its closed position whereby, upon reopening said cross web, said second stop member will move around said first stop member which allows said cross web to be fully inserted into said slot, at which position said cross members and said notches are non-aligned.

18. The apparatus of claim 17 wherein said side rail includes an elongated generally rectangular spine having a front surface, a rear surface and right and left edge surfaces.

19. The apparatus of claim 18 wherein said front surface includes a longitudinally extending centrally aligned bead portion giving said side rail a generally T-shaped cross-sectional profile.

20. The apparatus of claim 19 wherein said rear surface of said spine includes flange means thereon which extend orthogonally outwardly from said rear surface.

21. The apparatus of claim 20 wherein said slot in said connecting portion of the retainer means includes an inner portion and an outer portion, said inner portion being shaped and sized to receive said side rail thereinto and to allow said side rail to rotate therewithin, said outer portion being shaped and sized to closely and slidably receive said bead therein when said cross web is in its open position.

22. The apparatus of claim 21 wherein said outer portion of said slot has a left side edge and a right side edge.

23. The apparatus of claim 22 wherein said flange means on said side rail bear against one of said left or right side edges of the outer portion of said slot to bias said side rail against the other of said left or right side edges of the slot when the cross web is in its closed position.

24. The apparatus of claim 23 wherein said inner portion of said slot includes cam means disposed therein which engage said flange means on the spine of the side rail to bias said bead into the outer portion of said slot when the cross web is in its open position.

25. The apparatus of claim 24 wherein the closed lower end of said slot limits the total insertion of the side rail into the connecting portion.

26. The apparatus of claim 25 further including second cooperating means between said connecting portion and said cross web to hold the cross web in its fully inserted position in said slot.

27. The apparatus of claim 26 wherein said second cooperating means comprises clip means that engage when said cross web is fully inserted into said connecting portion.

28. The apparatus of claim 10 wherein one of said cross members includes one or more clips for the attachment of reinforcing bar to said cross web.

29. The apparatus of claim 28 wherein the uppermost cross member is deviated downwardly for clearance of any of said reinforcing bar clips located thereon relative to the upper ends of said side rails.

30. Apparatus for a concrete form for an insulated wall, comprising:

first and second wall panels arranged in opposed spaced apart parallel relationship, each panel having an inner surface, an outer surface, an upper edge surface, a lower edge surface and end surfaces;

a plurality of retainer means secured within each of said first and second panels at spaced apart intervals, each retainer means including a connecting portion extending outwardly from said inner surface of each of said panels, and an anchoring portion including:

a framework disposed within said panels;

an upper connector extending upwardly from each panel's upper edge surface; and a lower connector extending downwardly from each panel's lower edge surface, said upper and lower connectors being adapted to respectively engage selected ones of the upper and lower connectors of the next vertically adjacent panel to securely attach said panels together; and a plurality of cross webs extending between said first and second panels to tie them together, said cross webs being adapted for respective connection to the connecting portion of opposed retainer means in said first and second panels; wherein said framework of said anchoring portion includes a top plate and a bottom plate interconnected on one side thereof by said connecting portion and on the other side thereof by column members, and a plurality of spaced apart rib members extending orthogonally between said connecting portion and said column members.

31. The apparatus of claim 30 wherein said column members define a pair of spaced apart longitudinally extending spines having a space therebetween.

32. The apparatus of claim 31 additionally including a fastening strip connectable into the space between said spines, said fastening strip being adapted to receive fasteners thereinto for the connection of wall treatments to the outer surfaces of said panels.

33. The apparatus of claim 32 wherein said fastening strip has an outer surface having a plurality of closely spaced pilot holes formed therein to facilitate the insertion of fasteners into said fastening strip.

34. The apparatus of claim 32 wherein said fastening strip includes a plurality of spring clips and said spines include a corresponding number of spring clip receiving means thereon for engaging said spring clips to securely connect said fastening strip to said anchoring portion.

35. The apparatus of claim 33 including a plurality of stand-offs extending orthogonally outwardly from the outer surface of said fastening strip.

36. The apparatus of claim 31 including bracing members extending laterally between the column members of each of said spines.

37. The apparatus of claim 30 wherein the spaces between adjacent ones of said ribs and between adjacent ones of said ribs and said top and bottom plates are substantially unobstructed for anchoring of said framework in said panel.

38. The apparatus of claim 30 wherein said retainer means are approximately 3 inches wide.

39. The apparatus of claim 35 wherein said upper and lower connectors are approximately 5 inches long.

40. The apparatus of claim 30 wherein said upper connector is connected to and extends upwardly from said top plate.

41. The apparatus of claim 30 wherein said lower connector is connected to and extends downwardly from said lower plate.

42. The apparatus of claim 41 wherein said first and second panels comprise an insulating material.

43. The apparatus of claim 42 wherein said insulating material is plastic foam.

44. The apparatus of claim 43 wherein said plastic foam is expanded polystyrene.

45. The apparatus of claim 44 wherein said plastic foam is molded into and around said framework and said fastening strip.

46. The apparatus of claim 45 wherein said retainer means are spaced at 8 inch intervals in said first and second panels.

47. The apparatus of claim 46 wherein each of said panels is 48 inches long and 16 inches high.

48. The apparatus of claim 47 wherein said retainer means, cross members and fastening strip are formed from a relatively non-compressible plastic material.

49. The apparatus of claim 48 wherein the plastic material is polypropylene.

50. Apparatus to form a corner in an insulated concrete form, comprising:

a first outside corner wall panel and a second inside corner wall panel, said first and second panels arranged in opposed spaced apart relationship to define said corner between them, each panel having an inner surface, an outer surface, an upper edge surface, a lower edge surface and end surfaces;

a plurality of retainer means secured within each of said first and second panels at spaced apart intervals, each retainer means including a connecting portion extending outwardly from said inner surface of each of said panels;

a plurality of cross webs extending between said first and second panels to tie them together, said cross webs being adapted for respective connection to the connecting portion of opposed retainer means in said first and second panels, each of said cross webs comprising a pair of spaced apart side rails and a plurality of cross members extending orthogonally between the side rails at spaced apart intervals, and said connecting portion of said retainer means defining a longitudinally extending slot shaped to slidingly receive a respective one of said side rails thereinto to connect the two and to prevent separation therebetween; and a cross web connector for connecting together two orthogonally disposed cross webs at said corner, wherein one of said two orthogonally disposed cross webs is fully connected between said first and second panels and the other of said cross webs is connected to only one of said panels to have an unconnected side, said cross web connector connecting said unconnected side to the fully connected cross web, said cross web connector having first and second sides, said first side being adapted for connection to said fully connected cross web, and said second side including slot means shaped to slidingly receive the side rail on the unconnected side of the cross web thereinto.

51. The apparatus of claim 5 wherein said first and second panels each have a longer leg on one side of the corner and a shorter leg on the other side of the corner, with said longer and shorter legs being reversable in the next vertically adjacent row of panels for a staggered vertical array of said first and second panels about the corner.

52. Apparatus to form a T-shaped intersection in an insulated concrete form, comprising:

a first inside corner wall panel, a second opposite inside corner wall panel and a third straight wall panel, said first, second and third panel being arranged to define a T-intersection between them, each of said panels having an inner surface, an outer surface, an upper edge surface, a lower edge surface and end surfaces;

a plurality of retainer means secured within each of said first, second and third panels at spaced apart intervals, each retainer means including a connecting portion extending outwardly from said inner surface of each of said panels;

a plurality of cross webs extending between said first, second and third panels to tie them together, said cross webs being adapted for respective connection to the connecting portion of opposed retainer means in said first and second panels, each of said cross webs comprising a pair of spaced apart side rails and a plurality of cross members extending orthogonally between the side rails at spaced apart intervals, and said connecting portion of said retainer means defining a longitudinally extending slot shaped to slidingly receive a respective one of said side rails thereinto to connect the two and to prevent separation therebetween; and a cross web connector for connecting together two orthogonally disposed cross webs at said T-intersection, one of said two orthogonally disposed cross webs being fully connected between said first and second panels and the other of said cross webs being connected on one side only to said third panel to have an unconnected side, said cross web connector connecting said unconnected side to the fully connected cross web, wherein said cross web connector has first and second sides, said first side being adapted for connection to said fully connected cross web, and said second side including slot means shaped to slidingly receive the side rail on the unconnected side of the other cross web thereinto.

53. The apparatus of claim 52 wherein said first and second panels each have a long leg on one side of the corner and a short leg on the other side of the corner, and said third straight panel having both a short and long form, with said longer and shorter legs of said first and second panels being reversable in the next vertically adjacent row of panels which, in combination with alternating longer and shorter forms of the third panel, provide for a staggered vertical array of said first, second and third panels about the T-intersection.

* * * * *